US011350217B2

(12) United States Patent
Stoppel et al.

(10) Patent No.: US 11,350,217 B2
(45) Date of Patent: May 31, 2022

(54) MICROMECHANICAL SOUND TRANSDUCER

(71) Applicant: Fraunhofer-Gesellschaft zur Foerderung der angewandten Forschung e.V., Munich (DE)

(72) Inventors: Fabian Stoppel, Itzehoe (DE); Bernhard Wagner, Looft (DE); Shanshan Gu-Stoppel, Itzehoe (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 231 days.

(21) Appl. No.: 16/693,016

(22) Filed: Nov. 22, 2019

(65) Prior Publication Data

US 2020/0100033 A1 Mar. 26, 2020

Related U.S. Application Data

(63) Continuation of application No. PCT/EP2018/063961, filed on May 28, 2018.

(30) Foreign Application Priority Data

May 26, 2017 (DE) ..... 10 2017 208 911.3

(51) Int. Cl.
*H04R 25/00* (2006.01)
*H04R 17/00* (2006.01)
(Continued)

(52) U.S. Cl.
CPC ..... *H04R 17/00* (2013.01); *H04R 7/06* (2013.01); *H04R 7/26* (2013.01)

(58) Field of Classification Search
CPC ..... H04R 25/402; H04R 1/025; H04R 1/403; H04R 1/02; H04R 1/40; H04R 25/00
See application file for complete search history.

(56) References Cited

U.S. PATENT DOCUMENTS 7,003,125 B2 2/2006 Yi et al.
7,089,069 B2 8/2006 Gabriel et al.
(Continued)

FOREIGN PATENT DOCUMENTS

CN 101841756 A 9/2010
CN 104540776 A 4/2015
(Continued)

OTHER PUBLICATIONS

Dejaeger, R., et al., "Development and Characterization of a Piezoelectrically Actuated MEMS Digital Loudspeaker", SciVerse ScienceDirect; Procedia Engineering vol. 47; Sep. 9-12, 2012, pp. 184-187, Sep. 2012.
(Continued)

*Primary Examiner* — Amir H Etesam
(74) *Attorney, Agent, or Firm* — Perkins Coie LLP; Michael A. Glenn

(57) ABSTRACT

A micromechanical sound transducer according to a first aspect includes a first bending transducer with a free end and a second bending transducer with a free end, the two bending transducers being arranged in a mutual plane, wherein the free end of the first bending transducer is separated from the free end of the second bending transducer via a slit. The second bending transducer is excited in-phase with the vertical vibration of the first bending transducer. A micromechanical sound transducer according to a second aspect includes a first bending transducer that is excited to vibrate vertically and a diaphragm element extending vertically to the first bending transducer, the diaphragm element being separated from a free end of the first bending transducer via a slit.

56 Claims, 23 Drawing Sheets

(51) Int. Cl.
*H04R 7/06* (2006.01)
*H04R 7/26* (2006.01)

(56) References Cited

U.S. PATENT DOCUMENTS

| | | | | |
|---|---|---|---|---|
| 8,280,079 | B2 | 10/2012 | Chung et al. | |
| 9,212,045 | B1 | 12/2015 | Schmid et al. | |
| 2002/0018334 | A1 | 2/2002 | Hill et al. | |
| 2006/0107744 | A1 | 5/2006 | Li et al. | |
| 2006/0196272 | A1 | 9/2006 | Sugiura et al. | |
| 2007/0058825 | A1 | 3/2007 | Suzuki et al. | |
| 2010/0254547 | A1 | 10/2010 | Grosh et al. | |
| 2010/0296681 | A1 | 11/2010 | Albach et al. | |
| 2010/0316242 | A1 | 12/2010 | Cohen et al. | |
| 2011/0051985 | A1 | 3/2011 | Hwang et al. | |
| 2011/0235829 | A1 | 9/2011 | Yang et al. | |
| 2012/0053393 | A1 | 3/2012 | Kaltenbacher et al. | |
| 2013/0156253 | A1 | 6/2013 | Lemarquand et al. | |
| 2013/0294636 | A1 | 11/2013 | Cassett et al. | |
| 2014/0000378 | A1* | 1/2014 | Shimoyama | G01L 13/02 73/754 |
| 2014/0207435 | A1 | 7/2014 | Koehler et al. | |
| 2015/0362394 | A1 | 12/2015 | Shimoyama et al. | |
| 2017/0022046 | A1 | 1/2017 | Buck et al. | |
| 2018/0179048 | A1 | 6/2018 | Schenk et al. | |
| 2019/0141453 | A1* | 5/2019 | Kim | H03F 3/187 |
| 2019/0281393 | A1 | 9/2019 | Grosh et al. | |

FOREIGN PATENT DOCUMENTS

| | | | |
|---|---|---|---|
| DE | 102006005048 | A1 | 9/2006 |
| DE | 102010009453 | A1 | 9/2011 |
| DE | 102015213757 | A1 | 2/2016 |
| DE | 102015210919 | A1 | 12/2016 |
| DE | 102015213771 | A1 | 1/2017 |
| EP | 2254353 | A2 | 11/2010 |
| EP | 2362686 | A2 | 8/2011 |
| EP | 2692153 | B1 | 12/2016 |
| JP | 2014515214 | A | 6/2014 |
| JP | 5674167 | B2 | 1/2015 |
| KR | 20050059075 | A | 6/2005 |
| WO | 2013002847 | A1 | 1/2013 |
| WO | 2016202790 | A2 | 12/2016 |

OTHER PUBLICATIONS

Glacer, Christoph , et al., "Reversible acoustical transducers in MEMS technology", Spain, Barcelona; Apr. 16-18, 2013; 4 pages;, Apr. 2013.

Houdouin, Alexandre , et al., "Acoustic vs electric power response of a high-performance MEMS microspeaker", IEEE Sensors Nov. 2014; 5 pages;, Nov. 2014.

Yi, Seunghwan , et al., "Performance of packaged piezoelectric microspeakers depending on the material properties", Proc. MEMS 2009, 765-768;, 2009.

* cited by examiner

MICROMECHANICAL SOUND TRANSDUCER

CROSS-REFERENCES TO RELATED APPLICATIONS

This application is a continuation of copending International Application No. PCT/EP2018/063961, filed May 28, 2018, which is incorporated herein by reference in its entirety, and additionally claims priority from German Applications No. DE 10 2017 208 911.3, filed May 26, 2017, which is incorporated herein by reference in its entirety.

BACKGROUND OF THE INVENTION

Embodiments of the present invention refers to a micromechanical sound transducer with at least one bending actuator (in general: bending transducer) and a miniaturized slit as well as to a miniaturized sound transducer having a cascaded bending transducer. Additional embodiments concern corresponding manufacturing methods.

Although MEMS are used in almost all areas, miniaturized sound transducers are still manufactured using precision engineering. These so-called "micro-speakers" are based on an electrodynamic driving systems wherein a membrane is deflected by a moving coil that moves in a permanent magnetic field. A significant disadvantage of these conventional electrodynamic sound transducers is their low efficiency and the resulting high power consumption of often times more than one watt. In addition, such sound transducers do not comprise any position sensor systems, so that the movement of the membrane is unregulated and large distortions occur at higher sound pressure levels. Further disadvantages are large series deviations as well as large height dimensions of often times more than 3 mm.

Due to ultra-precise manufacturing methods as well as energy-efficient driving principles, MEMS have the potential to overcome these disadvantages and to enable a new generation of sound transducers. However, it still is a fundamental problem that the sound pressure levels of MEMS sound transducers are too low. The primary reason for this is the difficulty to generate sufficiently large stroke movements with dimensions that are as small as possible. A further complicating factor is that in order to prevent an acoustic short circuit, a membrane is needed which has a negative effect on the overall deflection due to its additional spring stiffness. The latter may be minimized by using very soft and three-dimensionally shaped membranes (e.g. having a torus), which, however, may currently not be manufactured using MEMS technology and may therefore only be integrated in a complex and costly hybrid manner.

Publications and patent specifications concern MEMS sound transducers of different implementations, which has not resulted in market-ready products due to, inter alia, the above-mentioned problems. These concepts are based on closed membranes that are set in vibration and that generate sound. For example, [Hou13. US2013/156253A1] describes an electrodynamic MEMS sound transducer using the hybrid integration of a polyimide membrane and a permanent magnet ring. [Yi09, Dej12, U.S. Pat. Nos. 7,003,125, 8,280,079, US2013/0294636A1] illustrates the concept of piezoelectric MEMS sound transducers. Here, piezoelectric materials such as PZT, AlN or ZnO are directly applied onto silicon-based sound transducer membranes, however, which do not allow for sufficiently large deflections due to their low elasticity. [US 20110051985A1] illustrates a further piezoelectric MEMS sound transducer having a plate-shaped body that is deflected out of the plane in a piston-shaped manner via a membrane or several actuators. [Gla13, U.S. Pat. No. 7,089,069, US20100316242A1] describe digital MEMS sound transducers on the basis of arrays having electrostatically-driven membranes, however, which are capable to generate sufficiently high sound pressures only at high frequencies. Thus, there is a need for an improved approach.

SUMMARY

According to an embodiment, a micromechanical sound transducer for emitting sound, being set up in a substrate, may have: a first bending transducer that extends along a plane of the substrate and has a free end or a free side and is configured to be excited to vibrate vertically in order to emit or receive a sound; and a diaphragm element extending vertically to the first bending transducer, the diaphragm element being separated from the free end or the free side of the first bending transducer via a slit; wherein the slit is smaller than 5% or smaller than 1% or smaller than 0.1% or smaller than 0.01% of the surface area of the first bending transducer and wherein, upon a deflection, the slit is smaller than 10%, 5%, 1%, 0.1% or 0.01% of the surface area of the first bending transducer.

According to another embodiment, a micromechanical sound transducer set up in a substrate may have: a first bending transducer that extends along a plane of the substrate and has a free end or a free side and is configured to be excited to vibrate vertically in order to emit or receive a sound; and a diaphragm element extending vertically to the first bending transducer, the diaphragm element being separated from the free end or the free side of the first bending transducer via a slit; wherein the micromechanical sound transducer has a lid that is placed onto the substrate in the area of the first bending transducer so that at least the first bending transducer and the diaphragm element are covered by the lid or the first substrate, and wherein the lid forms the diaphragm element.

Another embodiment may have a method for manufacturing a micromechanical sound transducer set up in a substrate, the micromechanical sound transducer having a first bending transducer extending along a plane of the substrate, and a diaphragm element extending vertically to the first bending transducer, wherein the method may have the following steps: structuring a layer in order to form the first bending transducer so that it has a free end or a free side and is configured to be excited to vibrate vertically in order to emit or receive sound; and realizing the vertical diaphragm element so that it extends beyond the layer of the first bending transducer and is separated from the free end of the first bending transducer via a slit; wherein the slit is smaller than 5% or smaller than 1% or smaller than 0.1% or smaller than 0.01% of the surface area of the first bending transducer and wherein, upon a deflection, the slit is smaller than 10%, 5%, 1%, 0.1% or 0.01% of the surface area of the first bending transducer.

Another embodiment may have a method for manufacturing a micromechanical sound transducer set up in a substrate, the micromechanical sound transducer having a first bending transducer extending along a plane of the substrate, and a diaphragm element extending vertically to the first bending transducer, wherein the method may have: structuring a layer in order to form the first bending transducer so that it has a free end or a free side and is configured to be excited to vibrate vertically in order to emit or receive sound; and realizing the vertical diaphragm element so that it extends beyond the layer of the first bending transducer and is separated from the free end of the first bending transducer via a slit; wherein the micromechanical sound transducer has a lid that is placed onto the substrate in the area of the first bending transducer so that at least the first bending transducer and the diaphragm element are covered by the lid or the first substrate, and wherein the lid forms the diaphragm element.

Another embodiment may have a micromechanical sound transducer with a first bending transducer, wherein the micromechanical sound transducer may have a free end or a free side and be configured to be excited to vibrate vertically in order to emit or receive sound; wherein the first bending transducer has a first and a second bending element connected in series in order to form the first bending transducer, wherein the first bending element may be driven with a first control signal and the second bending element may be driven with a second control signal; wherein the first bending element has a clamped-in end and a free end, and the second element grips with its clamped-in end the free end of the first bending element and forms with its free end the free end of the first and/or the second bending transducer, and wherein the first bending element is connected to the second bending element via a flexible element or a connection element.

Another embodiment may have a method for manufacturing an inventive micromechanical sound transducer, the micromechanical sound transducer having a first bending transducer, wherein the method may have the following steps: providing in a mutual plane a first layer that at least forms the first bending transducer with a first and a second bending element each so that the first bending transducer has a free end; and connecting the respective first bending element to the second bending element of the respective first bending transducer.

Embodiments of the present invention provide a micromechanical sound transducer (e.g. set up in a substrate) with a first bending transducer, or bending actuator, and a second bending transducer, or bending actuator. The first bending actuator comprises a free end and, e.g., at least one or two free sides and is configured to be excited, e.g. by an audio signal, to vibrate vertically and to emit (or receive) sound. The second bending actuator also comprises a free end and is arranged opposite to the first bending actuator such that the first and the second bending actuator are located, or suspended, in a mutual plane. Furthermore, the arrangement is implemented such that a slit (e.g. in the micrometer range) separating the two bending actuators is formed between the first and the second bending actuator. The second bending actuator is excited to vibrate in-phase with the first bending actuator, which results in the slit essentially remaining constant across the entire deflection of the bending actuators.

Embodiments for this aspect of the invention are based on the finding that by using several separated bending transducers, or actuators, that are separated by a minimum (separation) slit, with the identical deflection of the two transducers, or actuators, out of the plane, it may be achieved that the slit remains approximately constantly small (in the micrometer range) between the two actuators so that there are high viscosity losses present in the slit that consequently prevent an acoustic short circuit between the rear volume and the front volume (of the bending actuator). Compared to existing MEMS systems that mostly are based on closed membranes, the present concept allows for a significant increase in performance. The primary reason is that, due to the decoupling of the actuator, no energy has to be used for deforming additional mechanical membrane elements, which allows for significantly higher deflections and forces. In addition, nonlinearities only occur at significantly larger movement amplitudes. While conventional systems sometimes need complexly shaped membranes and magnets that may so far not be realized in MEMS technology, but may only be integrated in a hybrid manner with large efforts, the present concept may be realized with known silicon technology methods. This provides significant advantages with respect to manufacturing processes and costs. Since, for reasons of concept and material, the vibrating mass is small, systems with extraordinary broad frequency ranges and at the same time large movement amplitudes may be realized.

A further aspect provides a micromechanical sound transducer with a first bending transducer, or bending actuator, (configured to be excited to vertically vibrate) and a diaphragm element extending vertically (i.e. out of the plate of the substrate and therefore also out of the extension plane of the bending transducer) to the first bending transducer, or bending actuator. The diaphragm element is separated by a slit (gap) from the free end of the first bending actuator.

The finding of this aspect is that, due to the diaphragm element, it may be achieved (due to the vibration) that the distance between the diaphragm element and the free end of the actuator approximately remains constant across the entire movement range of the transducer, or actuator. This achieves the same effect as above, i.e. an acoustic short circuit may be prevented due to the high viscosity losses at the free end (and possibly also at the free sides) or in the slit. As a result, the same advantages arise, in particular with respect to the efficiency of the sound transducer, the broadband characteristics and the manufacturing costs.

An embodiment refers to a manufacturing method of such an actuator with a diaphragm element. This method includes the following steps: structuring a layer in order to form the first bending actuator, and manufacturing or depositing the vertical diaphragm element so that it extends beyond the layer of the first bending actuator. The term vertical is to be understood as perpendicular (perpendicular to the substrate plane) or generally angular with respect to the substrate (angular range 75°-105°).

Regarding the variation with the at least two bending actuators, it is to be noted that, according to an embodiment, the first and the second bending actuator are bending actuators of the same type. For example, there may be planar, rectangular, trapezoid-shaped or general polygonal bending actuators. According to a further embodiment, these bending actuators may each have a triangular shape or a circular-segment shape. The triangular or circular-segment shape is often used in micromechanical sound transducers that include more than two bending actuators. Thus, according to a further embodiment, the micromechanical sound transducer includes one or several further bending actuators, e.g. three or four bending actuators.

As described above, driving the bending actuator simultaneously, or in-phase, or providing the diaphragm element makes it possible that, assuming a slit that (in an idle state) is smaller than 10% or even smaller than 5%, 2.5%, 1%, 0.1% or 0.01% of the surface area of the first bending actuator, the slit remains small across the entire movement range, i.e. even when deflected it comprises at most 15% or even only 10% (or 1% or 0.1% or 0.01%) of the surface area of the first bending actuator. Regarding the variation having the diaphragm element, it is to be noted that the height of the diaphragm element is dimensioned such that it amounts to at least 30% or 50% or advantageously 90% or even 100% or more of the maximum deflection of the first bending actuator in linear operation (i.e. a linear mechano-elastic range), or of the maximum elastic deflection of the first bending transducer (generally 5-100%). Alternatively, the height may be defined depending on the slit width (at least 0.5 times, 1 time, 3 times, or 5 times the slit width) or depending on the thickness of the bending transducer (at least 0.1 times, 0.5 times, 1 time, 3 times or 5 times the thickness). These dimensioning rules for the two variations allow for the above-described functionality/prevention of acoustic short circuits across the entire deflection range and therefore across the entire sound level range.

According to a further embodiment, a diaphragm element may not only be arranged opposite to the free end, but it may also be arranged, e.g., at the sides around the bending actuator that are not clamped in. In particular, this makes sense if the bending actuator is a bending actuator clamped in on one side.

According to an embodiment, the diaphragm element may comprise a varying geometry (e.g. a geometry that is curved/tiled towards the actuator) in its cross section so that the slit mostly has a constant cross section along the actuator movement. According to embodiments, the diaphragm may form a mechanical stop to prevent a mechanical overload.

A further embodiment provides a micromechanical sound transducer that includes a controller which drives the second bending actuator such that it is excited to vibrate in-phase with the first bending actuator. In addition, according to a further embodiment, it may be advantageous to provide a sensor system that senses the vibration and/or position of the first and/or second bending actuator to allow the controller to drive the two bending actuators in-phase. In contrast to conventional systems that mostly do not have a sensor system and that only sense the deflection of the drive (not only the membrane), in this principle, the actual position of the sound-generating element may be easily determined by means of a well-integrable sensor system. This is very advantageous and allows for a significantly more precise and reliable detection. This forms the basis for a regulated excitation (closed-loop) which may electronically compensate for external influences, aging effects and nonlinearities.

According to an embodiment, the bending actuators may also comprise a so-called "cascade connection (cascading)". That is, the first and/or second bending actuator each includes at least one first and second bending element. These elements are connected in series. According to embodiments, "connected in series" means that the first and the second bending element comprise a clamped-in end and a free end, and the second bending element grips with its clamped-in end the free end of the first bending actuator and forms with its free end the free end of the overall bending actuator. In this case, the connection between the two bending elements may be formed by a flexible element, for example. Optionally, the micromechanical sound transducer may comprise an additional frame that, e.g., is provided in an area of transition between the first and the second bending element. It serves for stiffening and for mode-decoupling. Regarding the two bending elements, it is to be noted that, according to an embodiment, they may be driven with different control signals so that, e.g., the inside bending element, or the inside bending elements, is used for higher frequencies, whereas the outside bending elements are driven to vibrate in a lower frequency range.

A further aspect provides a micromechanical sound transducer with at least one, advantageously two, bending actuators, wherein each bending actuator includes a first and a second bending element that are connected in series. According to a further embodiment, such bending actuators may comprise a flexible connection instead of a separation slit.

Embodiments of this aspect of the invention are based on the finding that by using a serial connection of several bending elements of a bending actuator, it may be achieved that different bending actuators are responsible for different frequency ranges. Thus, e.g., the inside bending actuator may be configured for a high frequency range, whereas the one further on the outside may be operated for a low frequency range. In contrast to conventional membrane approaches, the concept described herein enables a cascade connection with several individually drivable actuator stages. In addition, due to the frequency-separated control in combination with the piezoelectric drives, significant increases in the energy efficiency may be achieved. The high-quality mode-decoupling provides advantages in the reproduction quality. For example, the realization of particularly space-efficient multi-way sound transducers is a further advantage.

Even in this embodiment of the bending actuator with the cascade connection, the further developments described above may also be applied according to additional embodiments. Here, in particular, the features with respect to the exact implementation of the cascade connection, e.g. the connection element or the frame, are to be mentioned. In addition, the sub-aspects with respect to the planar, rectangular, trapezoid-shaped or triangular (generally polygonal) bending actuator geometry for cascaded sound transducer configurations are relevant.

A further embodiment refers to a method for manufacturing a micromechanical sound transducer with cascaded bending actuators. The method includes the following steps: providing a first layer that forms the first (and the second) bending actuator with the first and the second bending element (respectively), and connecting the first and the second bending element (respectively).

According to an embodiment, it would be conceivable to interleave actuators within each other and/or to design them in different sizes, e.g., in order to cover different frequency ranges.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
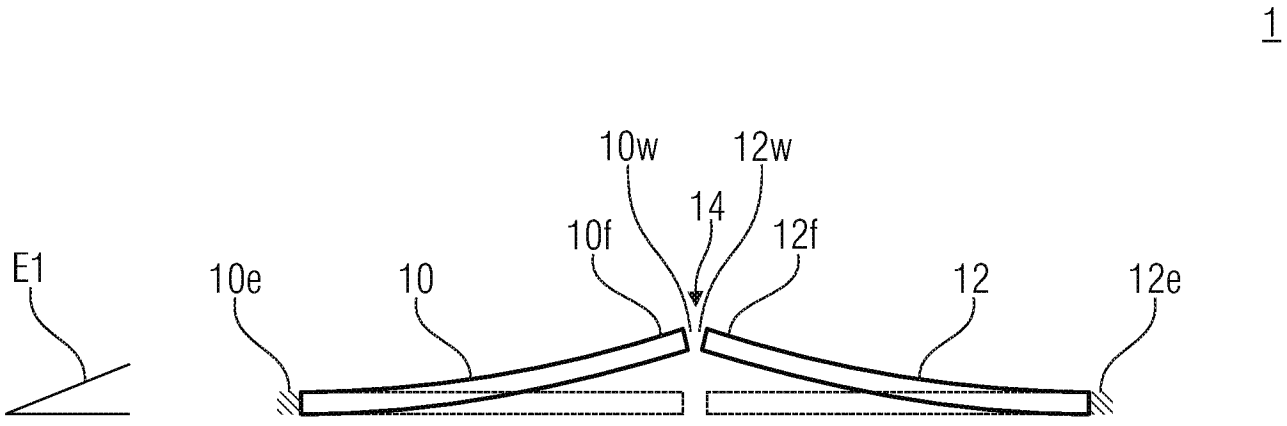
FIG. 1*a* shows a schematic illustration of a micromechanical sound transducer with two bending actuators according to an embodiment.

Before embodiments of the present invention are subsequently described in more detail based on the drawings, it is to be noted that elements and structures with the same effect are provided with the same reference numerals so that their description is may be applied to each other and may be interchanged with each other.

FIG. 1*a* shows a sound transducer 1 with a first bending actuator 10 and a second bending actuator 12. Both are arranged, or clamped in, in a plane E1, as can be seen based on the clampings 10*e* and 12*e*. The clamping may be realized by the bending actuators 10 and 12 being etched out from a mutual substrate (not illustrated) so that the bending actuators 10 and 12 are connected to the substrate on one side, and by a (mutual) cavity (no illustrated) being formed below the actuators 10 and 12. At this point, it is to be noted that the illustrated bending actuators 10 and 12 may be biased, for example, so that the illustration either shows an idle state or a deflected snapshot (if this the case, the idle state is illustrated by means of the dotted line). As can be seen, the two actuators 10 and 12 are arranged so as to be horizontally next to each other so that the actuators 10 and 12 or at least the clampings 10*e* and 12*e* are in a mutual plane E1. Advantageously, this statement refers to the idle state, wherein, in the biased case, the plane E1 mostly refers to the mutual clamping regions 10*e* and 12*e*.

The two actuators 10 and 12 are arranged opposite to each other so that a slit 14, for example of 5 μm, 25 μm or 50 μm (generally in the range between 1 μm and 90 μm, advantageously smaller than 50 μm or smaller than 20 μm), is present between the two. This slit 14, which separates the two bending actuators 12 and 14 clamped in on one side, may be referred to as decoupling slit. The decoupling slit 14 varies only minimally across the entire deflection range of the actuators 10 and 12, e.g. by a factor of 1, 1.5 or 4 (generally in the range of 0.5-5), i.e. variations smaller than +500%, +300%, +100% or +75% or smaller than +50% of the slit width (in the idle state), in order to be able to omit an additional sealing, as will be explained in the following.

Advantageously, the actuators 10 and 12 are driven in a piezoelectric manner. For example, each of these actuators 10 and 12 may comprise a layer structure and, beside the piezoelectric active layers, may comprise one or several passive functional layers. Alternatively, electrostatic, thermal or magnetic driving principles are possible. If a voltage is applied to the actuator 12, it deforms itself, or in the piezoelectric case, the piezoelectric material of the actuators 10 and 12 deforms itself and causes the actuators 10 and 12 to bend out of the plane. This bending results in a displacement of air. With a cyclical control signal, the respective actuator 10 and 12 is excited to vibrate in order to emit (or in the case of a microphone: to receive) a sound signal. The actuators 10 and 12, or the corresponding drive signal, are configured such that respectively neighboring actuator edges, or the free ends, of the actuators 10 and 12 experience an approximately identical deflection out of the plane E1. The free ends are indicated with the reference numerals 10*f* and 12*f*. Since the actuators 10 and 12, or the free ends 10*f* and 12*f*, move in parallel to each other, they are in-phase. Thus, the deflection of the actuators 10 and 12 is referred to as being in-phase.

As a consequence, a continuous deflection profile that is only interrupted by narrow decoupling slits 14 is formed in the total structure of all actuators 10 and 12 in the driven state. Since the slit width of the decoupling slits is in the micrometer range, high viscosity losses are achieved at the slit sidewalls 10*w* and 12*w* so that the airflow passing through is strongly throttled. Thus, the dynamic pressure equalization between the front side and the rear side of the actuators 10 and 12 may not take place fast enough so that an acoustical short circuit is reduced regardless of the actuator frequency. This means that, in the considered acoustic frequency range, an actuator structure with a narrow slit behaves like a closed membrane with respect to fluidics.

Figure 1B:
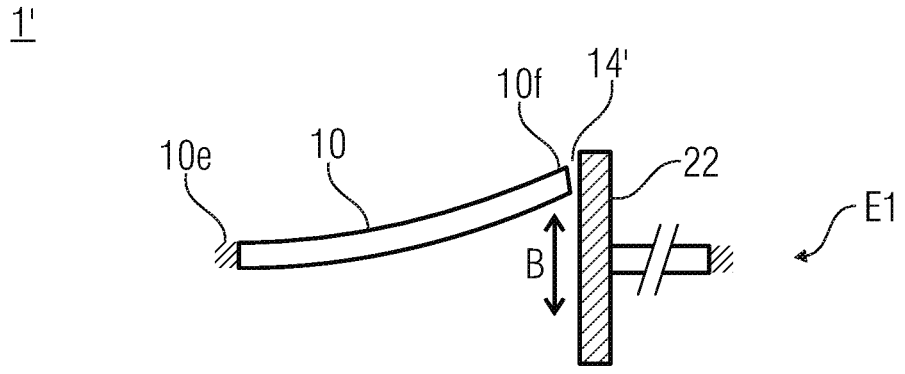
FIG. 1*b* shows a schematic illustration of a micromechanical sound transducer with one bending actuator and a vertical diaphragm element according to a further basic embodiment.

FIG. 1*b* shows a further variation as to how an actuator of a micromechanical sound transducer without a sealing may obtain a good sound pressure behavior. The embodiment of FIG. 1*b* shows the sound transducer 1' including the actuator 10 fixedly clamped in at the point 10*e*. The bending actuator 10 may be etched out of a substrate (not illustrated) so that a cavity (not illustrated) is formed below the same. The free end 10*f* may be excited to vibrate across a range B. A vertically arranged diaphragm element 22 is provided opposite to the free end 10*f*. Advantageously, this diaphragm element is at least as large as or larger than the movement range B of the free end 10*f*. Advantageously, the diaphragm elements 22 extend on the front side and/or rear side of the actuator, i.e. viewed from the plane E1 (substrate plane), in a lower plane and a higher plane (e.g. perpendicular to the substrate). A slit 14' comparable to the slit 14 of FIG. 1*a* is provided between the diaphragm element 22 and the free end 10*f*.

Even in the deflected state (cf. B), the diaphragm element 22 makes it possible to keep the width of the provided decoupling slits 14' to be approximately the same. Thus, in this configuration with the neighboring edges, there are no significant openings due the deflection, as is illustrated in FIG. 1*c*, for example.

Figure 1C:
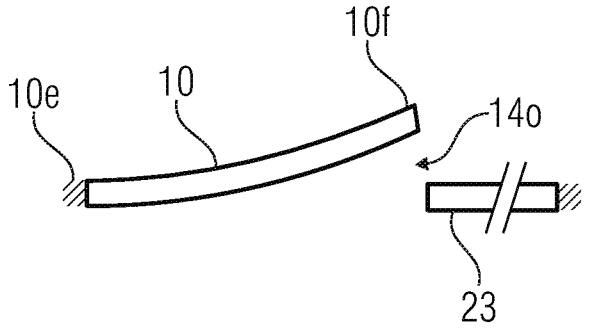
FIG. 1*c* shows a schematic illustration of a bending actuator with an adjacent structure in order to depict the improvement of the concepts of FIGS. 1*a* and 1*b* in contrast to the conventional technology.

FIG. 1*c* shows an actuator 10 also clamped in at the point 10*e*. An arbitrarily adjacent structure 23 without vertical expansion and movement is provided opposite thereto. Due to a deflection of the actuator 10, there is an opening in the area of the free end 10*f* of the actuator. This opening is indicated with the reference sign "o". Depending on the deflection, these opening cross sections 14*o* may be significantly larger than the decoupling slits (see FIGS. 1*a* and 1*b*) or generally than a coupling slit in the idle state. Through the opening, an airflow may be present between the front side and the rear side, leading to an acoustic short circuit.

According to embodiments, the side surface of the diaphragm element 22 or the diaphragm element 22 may be adapted to the movement of the actuator 10 in the deflection range B. In practice, a concave shape would be conceivable.

The structure 1 of FIG. 1*a* and the structure 1' of FIG. 1*b* make it possible to prevent the acoustic short circuit by providing means that keep the decoupling slit 14, or 14' approximately constant across the entire movement range.

Figure 2C:
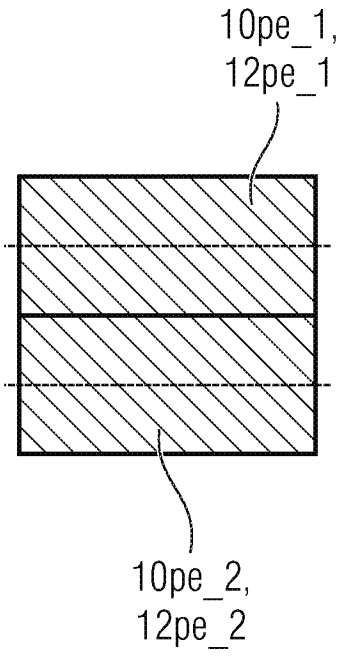
FIGS. 2*a-c* show schematic cross-sections of possible actuator elements according to embodiments.

As explained above, according to an embodiment, a piezoelectric material may be used. FIG. 2 shows three different cross sections of possible actuator elements in the illustrations a-c. FIG. 2*a* illustrates a unimorphous structure. Here, a piezoelectric layer 10*pe*, or 12*pe*, is applied on a passive layer 10*p*, 12*p*.

Figure 2B:
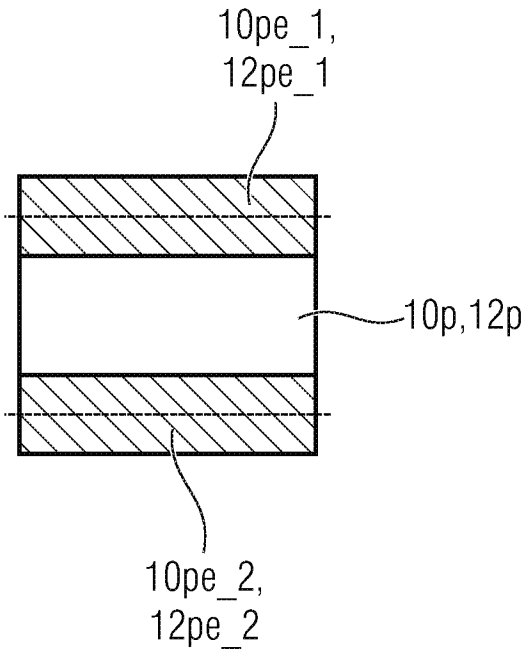
Figure 2A:
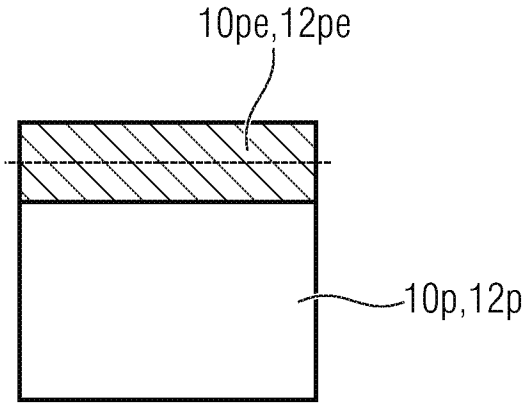

FIG. 2*b* shows a bimorphous structure. Provided here are two piezoelectric layers 10*pe*_1, or 12*pe*_1, and 10*pe*_2, or 12*pe*_2, as well as a passive intermediate layer 10*p*, or 12*p*.

FIG. 2*c* shows a piezoelectric layer stack with two piezoelectric layers 10*pe*_1, or 12*pe*_1, and 10*pe*_2, or 12*pe*_2.

All piezoelectric actuators shown in FIGS. 2*a* to 2*c* have in common that they are formed of at least two layers, i.e. a piezoelectric layer 10*pe*, or 12*pe*, and a further layer such as a passive layer 10*p*, or 12*p*, or a further piezoelectric layer 10*pe*_2, or 12*pe*_2. The piezoelectric layers 10*pe*, 12*pe*, 10*pe*_1, 12*pe*_1, 10*pe*_2, 12*pe*_2 may be configured as multilayer systems having additional separation layers (cf. layers 10*p*, 12*p*), and/or may be formed themselves from any number of sub-layers (cf. dotted lines). For example, the contacting is carried out by planar or inter-digital electrodes.

According to an alternative embodiment, a thermal drive that may comprise a multi-layer structure analogously to the piezoelectric actuators may be used. Fundamentally, the structure of a thermal drive then corresponds to the structure as described with respect to FIGS. 2*a-c* for piezoelectric layers, wherein thermally active layers are used instead of piezoelectric layers.

Figure 3C:
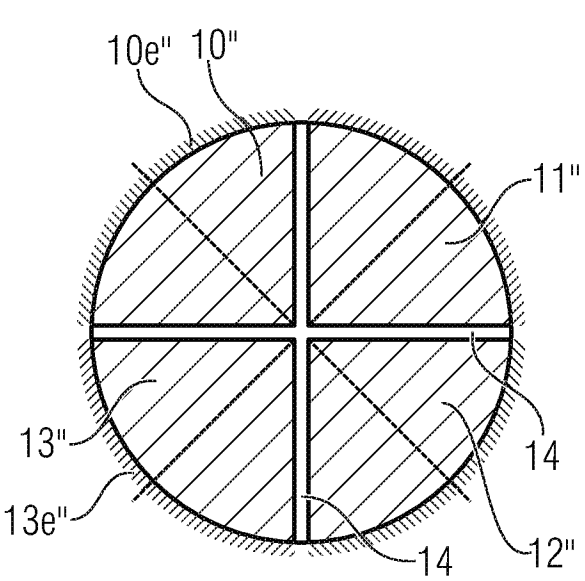
FIGS. 3*a-d* show schematic top views of bending actuator configurations according to embodiments.
Figure 3B:
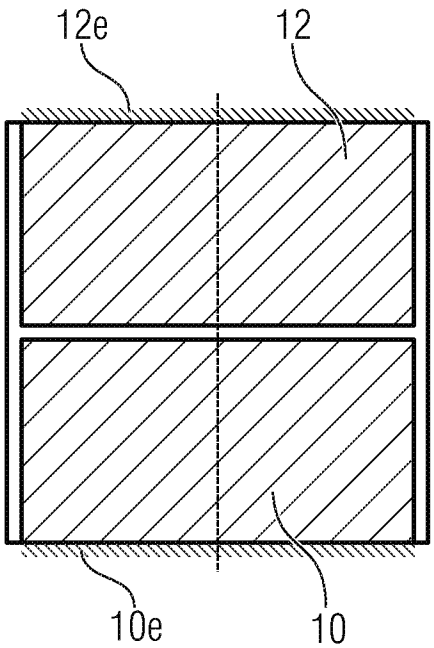
Figure 3A:
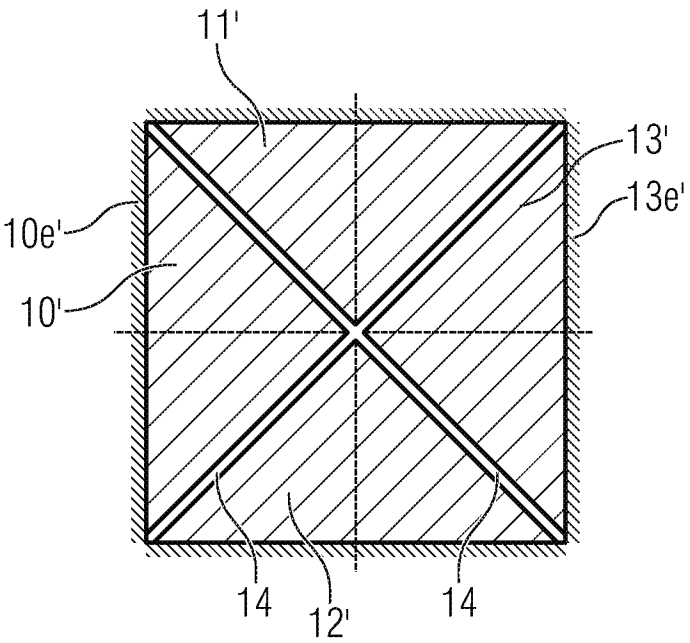

Different actuator arrangements including at least two opposite actuators (cf. FIG. 3*b*) are described with respect to FIGS. 3*a-c*.

FIG. 3*a* shows an actuator arrangement with four actuators 10', 11', 12' and 13'. Each of these actuators 10' to 13' is configured as a triangle and is clamped in on one side along the hypotenuse. According to an embodiment, these triangles are right-angled triangles so that the right-angled tips of the actuators 10' to 13' all come together in one point. As a consequence, the feedback slits 14 each extend between the legs.

According to embodiments, the individual actuators 10' to 13' may be further subdivided, as is indicated by means of the dotted lines. When subdivided, the clamping is obviously no longer done along the hypotenuse, but along one of the legs, while the decoupling slits extend along the hypotenuse and along the other leg.

Regardless as to whether there are four or eight actuators, the triangular implementation allows for neighboring free ends (separated by the respective slit 14) to experience as equal a deflection as possible.

FIG. 3*b* basically shows the top view of the embodiment of FIG. 1*a*, indicating that the actuator 10 and the actuator 12 may be subdivided, e.g., along the symmetry axis (cf. dotted line).

FIG. 3*c* shows a further implementation, wherein the entire sound transducer is arranged in a circular-segment shape, and comprises a total of four 90° segments as actuators 10" to 13" that are separated by the separation slits 14. With this circular sound transducer, the individual actuators 10" to 13" may again be further subdivided, as is indicated based on the dotted lines.

All embodiments of FIGS. 3*a* to 3*c* have in common that they are clamped in at the edge, as is indicated by the respective region 10*e*' to 13*e*', or 10*e* and 12*e*, or 10*e*" to 13*e*".

In addition, it is to be noted at this point that the separations slits 14 advantageously extend along the symmetry lines, as is shown based on the embodiments of FIGS. 3*a*-3*c*. Thus, in the embodiments with more than two actuators, this means that the separation slits meet in the focal point of the total area of the sound transducer according to an embodiment.

Figure 3D:
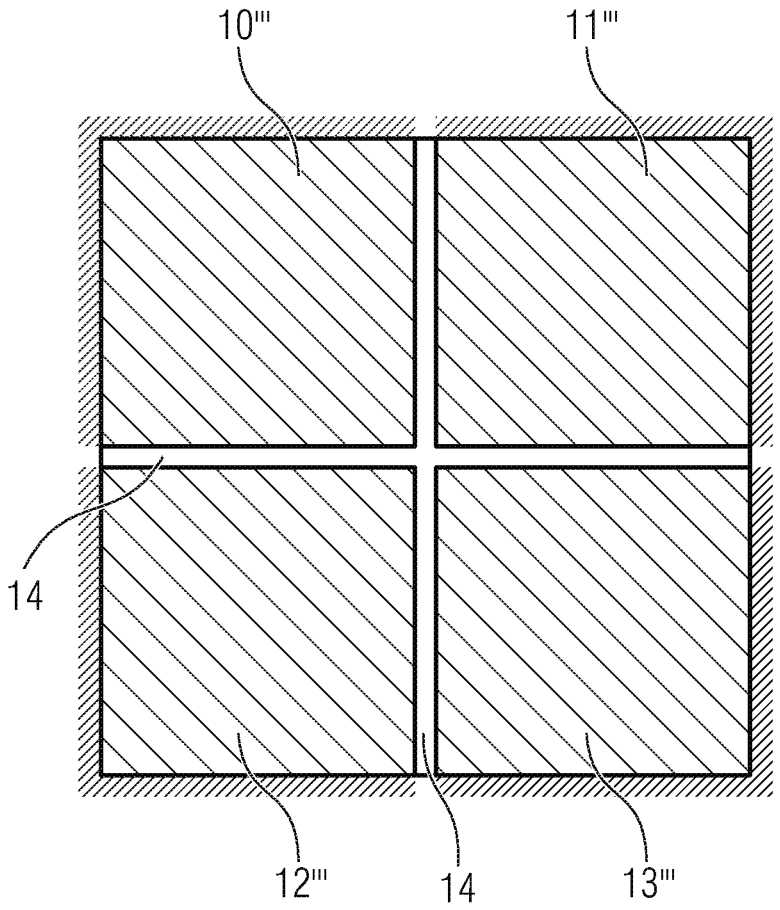

FIG. 3*d* shows (in top view) a further version of a micromechanical sound transducer with four (here rectangular, or square) actuators 10''', 11''', 12''' and 13''' that are arranged in the shape of four quadrants of a rectangle or a square. The four actuators 10''' to 13''' are separated by two crossing separations slits 14. Each of the actuators 10''' to 13''' is clamped in across the corner, i.e. on two sides at the outer edge.

Figure 4:
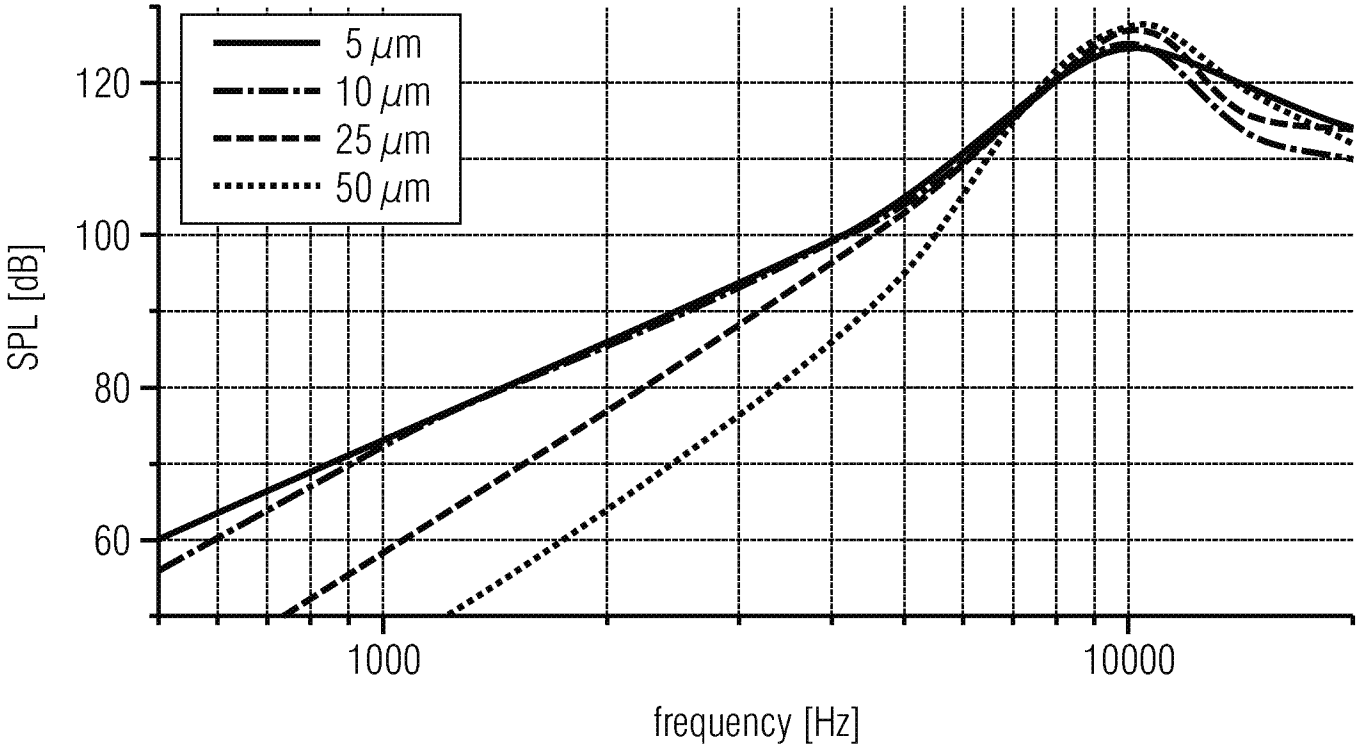
FIG. 4 shows a schematic diagram in order to illustrate a simulated sound pressure level for different embodiments.

FIG. 4 illustrates the influence of the slit width. FIG. 4 shows the resulting sound pressure level SPL across a frequency range of 500 Hz to 20 kHz for four different slit widths (5 μm, 10 μm, 25 μm, and 50 μm). In the illustrated frequency range, the reduction of the sound pressure level SPL (acoustic short circuit) may be neglected for column widths of below 10 μm, and the structure acoustically behaves like a closed membrane. As can further be seen, the influence of the slit width significantly decreases in larger frequency ranges (e.g. above 6000 Hz). In contrast to systems with closed membranes, the present systems distinguish themselves by a significantly higher efficiency as a result of the decoupling of the individual actuators. The latter is expressed in very large deflections and sound pressure levels. In addition, there are further advantages with respect to the linearity.

Figure 5:
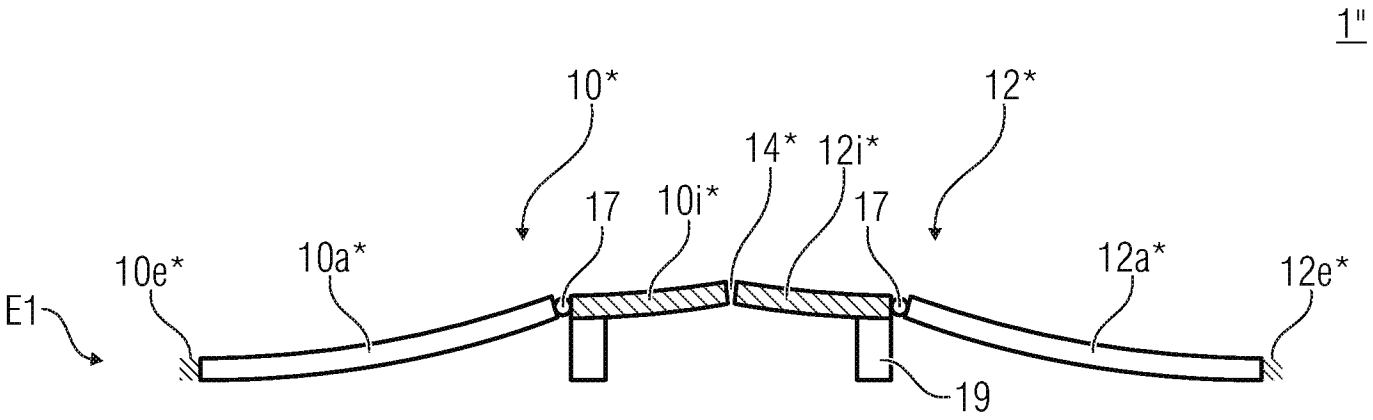
FIG. 5 shows a schematic illustration of a micromechanical sound transducer with two bending actuators each including a cascade connection, according to embodiments.

With respect to FIG. 5, an embodiment is described based on a corresponding further aspect. FIG. 5 shows a structure of a micromechanical sound transducer 1" with two actuators 10* and 12*. The two actuators 10* and 12* each include an inner stage and an outer stage. That is, the actuator 10* includes a first actuator element 10*a (outer stage) and a second actuator element 10*i (inner stage). Analogously, the actuator 12* includes the actuator element 12*a and the actuator element 12*i.

As is illustrated here, the outer stages 10*a and 12*a are clamped in, that is via the regions 10*e and 12*e. The opposite end of the actuators 10*a and 12*a, respectively, is referred to as free end. The inner stages 10*i and 12*i are coupled to this free end by means of optional connection elements 17. They are coupled such that the coupling is done via an end of the inner actuator elements 10*i, or 12*i, i.e. such that the opposite ends of the inner actuators 10*i**, or 12*i, serve as free ends. In other words, the actuator 10*, or 12*, is structured such that the inner stage 10*i (or 12*i*) is connected in series opposite to the outer stage 10*a (12*a***).

As is illustrated here, a decoupling slit 14* is formed between the free ends of the elements 10*i and 12*i. It is formed for all embodiments like the decoupling slit described in connection with the above embodiments (cf. FIG. 1*a*). That is, analogously to the above embodiments, the actuators 10* and 12* are separated from one another via a decoupling slit 14 having a size of a few micrometers, and they are advantageously implemented such that respectively neighboring structure edges (free edges of the inner elements 10*e and 12*e*) experience in operation as equal a deflection as possible (synchronous, or in-phase) out of the plane E1 (in which the actuators 10* and 12*, or the clamping regions 10*e and 12*e*, are arranged). Alternatively, a connection of the inner elements 10*i and 12*i would be possible in the area of the illustrated slit, e.g. by means of a flexible material.

According to optional embodiments, the individual cascaded stages may be located on a frame 19. In this embodiment, the frame 19 is arranged such that the clamped-in ends of the inner stages 10*i and 12*i are located on the same frame 19. However, in general, the frame 19 is advantageously arranged such that it is in the area of the connection points (cf. connection elements 17). The frame makes it possible to suppress parasitic vibration modes as well as undesired mechanical deformations.

Even if the above embodiments assume to provide two actuators 10* and 12* each having an inner and outer actuator stage with the actuator elements 10*a, 10*i, 12*a*, 12*i, it is to be noted that further embodiments provide a micromechanical sound transducer with only one actuator (e.g. the actuator 10*) having the first stage 10*a and the second 10*i accordingly arranged in series. For example, this actuator may freely vibrate opposite to a fixed end so that a slit is formed therebetween, or may be flexibly connected to a fixed end. According to a further embodiment, a diaphragm, as exemplarily described in FIG. 1*b*, would also be conceivable.

Figures 6A, 6B, 6C:
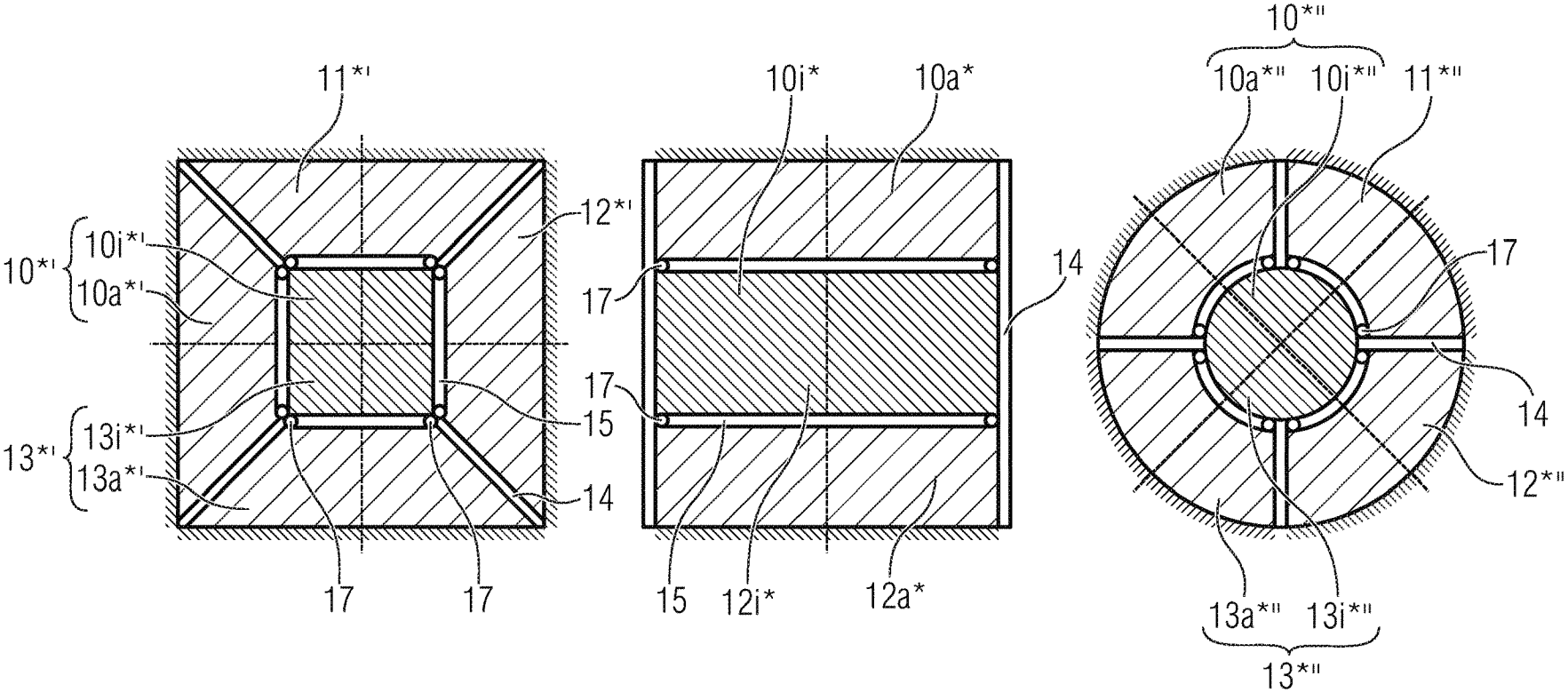
FIGS. 6*a-c* show schematic top views of bending actuator configurations with cascade connections, according to embodiments.

With respect to FIGS. 6*a* to 6*c*, three sound transducers according to embodiments are described in schematic top views, wherein the configurations of FIGS. 3*a* to 3*c* are enhanced by the cascade connection (two-stage cascaded configurations).

FIG. 6*a* shows a micromechanical sound transducer with four actuators 10*' to 13*', wherein each of the actuators 10*' to 13*' comprises two actuator elements 10*a*', or 10*i*', to 13*i*, or 13*a*'. The inner elements 10*i*' to 13*i*' are each triangular (with respect to the surface area), whereas the outer elements 10*a*' to 13*a*' are each trapezoid-shaped (with respect to the surface area). The smaller leg of the trapezoid actuator 10*a*' to 13*a*' is connected to the hypotenuse of the triangular actuator 10*i*' to 13*i*' via connection elements 17**. In this embodiment, the optional connection elements are advantageously arranged at corners of the trapezoid, or the triangle.

FIG. 6*b* basically shows in a top view the electromechanical sound transducer of FIG. 5 with the inner actuators 10*i and 12*i and the outer actuators 10*a and 12*a*. Here, connection elements 17 are also provided at the corners of the rectangular inner and outer elements 10*i, 10*a*, 12*i and 12*a*.

Based on the circular segment-shaped micromechanical sound transducer, FIG. 6*c* shows the cascaded actuators 10*" to 13*', wherein each actuator comprises an inner actuator element and an outer actuator element. The inner actuator elements 10*i*" to 13*i*" are configured as circular segment-shaped elements, whereas the outer elements 10*a*" to 13*a*" are configured as circular-disc segments. Again, the connection is done via connection elements 17.

According to embodiments, all embodiments of FIGS. 6*a* to 6*c* have in common that the actuators 10*' to 13*', or 10* to 12*, or 10*" to 13', are separated by separation slits 14. In addition, separation slits 15 may be provided between the inner actuators (e.g. 10*i*' and 10*a*'), which are only bridged via the connection elements 17. In other words, the outer stages (e.g. 10*a* and 12*a* in FIG. 6*b*) are connected to the second inner stages 10*i*, or 12*i*, via at least one connection element, however, advantageously via two or more connection elements 17 that are spaced apart. The connection elements may be implemented as mechanical spring elements or joints.

As is explained in connection with FIGS. 3*a-c*, the actuators may also be further subdivided so as to create any number of actuators per actuator element 10*, or 12* (cf. dotted line).

After having described the structure of the sound transducer, subsequently, its function will be described: in the driven state, the actuators of the outer stage deflect the inner stage out of the plane, wherein the actuators of the inner stage perform a further deflection. This results in a deflected structure that acoustically behaves like a closed membrane due to the high viscosity losses in the decoupling slits.

Alternatively, the cascaded overall structure may also comprise three or more stages. Optionally, the different stages may be controlled with identical or different drive signals. In the case of different drive signals, the stages may be operated in different frequency ranges, and, for example, may form a multi-way sound transducer with a particularly low space requirement.

At this point, it is to be noted that the concept of the flow diaphragms described with respect to FIG. 1*b* may also be extended to the multi-piece cascaded systems, e.g. to minimize acoustic losses between connection elements and actuators or intermediate stages.

With respect to the above embodiments, it is to be noted that the variations described in FIGS. 6*a* to 6*c* may be combined in any way according to additional embodiments. Thus, for example, it is possible to provide only two inner actuator elements 10*i and 12*i*, as is shown in FIG. 6*b*, instead of the four inner actuator elements 10*a*' to 13*a*' of FIG. 6*a*. Furthermore, it is also conceivable to only provide one inner actuator element, e.g. also in combination with a diaphragm (cf. embodiment of FIG. 1*b*).

Figure 7:
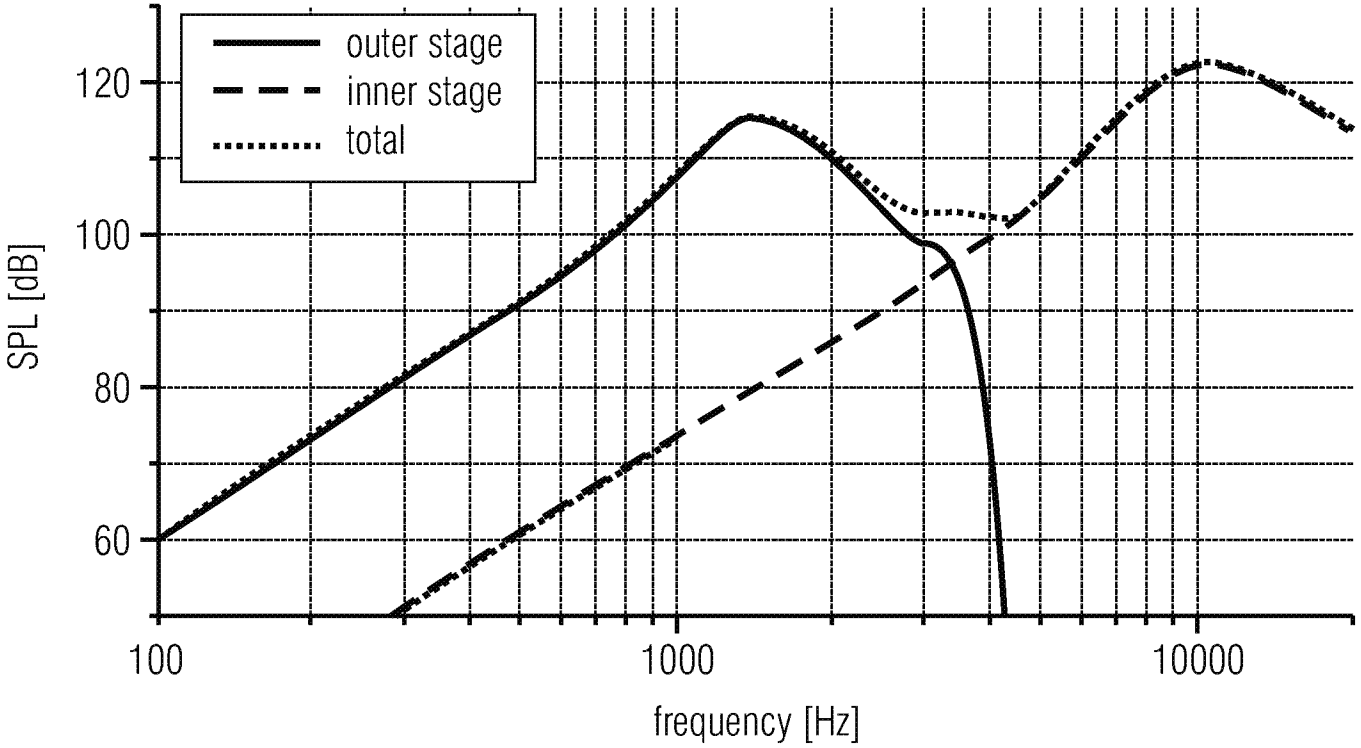
FIG. 7 shows a schematic diagram in order to depict a simulated sound pressure level with a bending actuator configuration with a cascade connection.

FIG. 7 shows a diagram of the simulated sound pressure across the frequency range, broken down according to inner and outer stage. As can be seen, the outer stage particularly serves the low frequency range (maximum sound pressure at around 1500 Hz), whereas the inner stage serves the higher frequency range (maximum sound pressure at around 10000 Hz). The present case assumes a MEMS sound transducer with a chip size of 1×1 cm, measured at a distance of 10 cm.

Figure 8B:
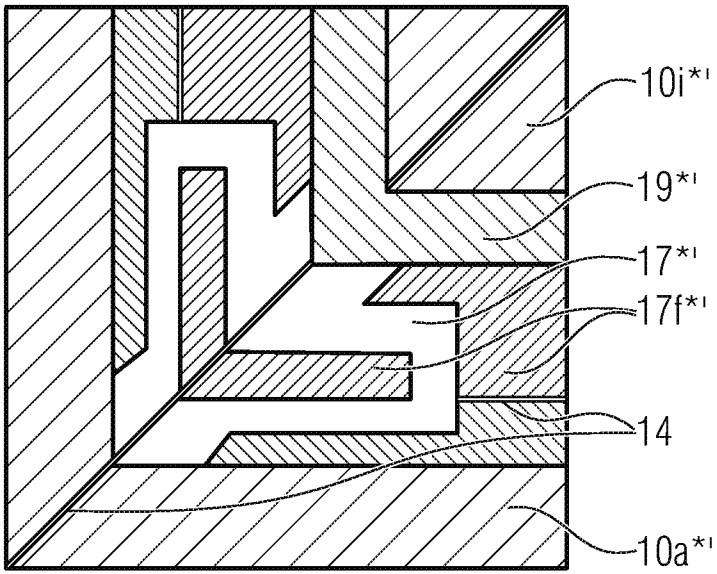
FIGS. 8*a,b* show schematic views or partial views of a top view of a bending actuator configuration with a cascade connection, according to a further embodiment.
Figure 8A:
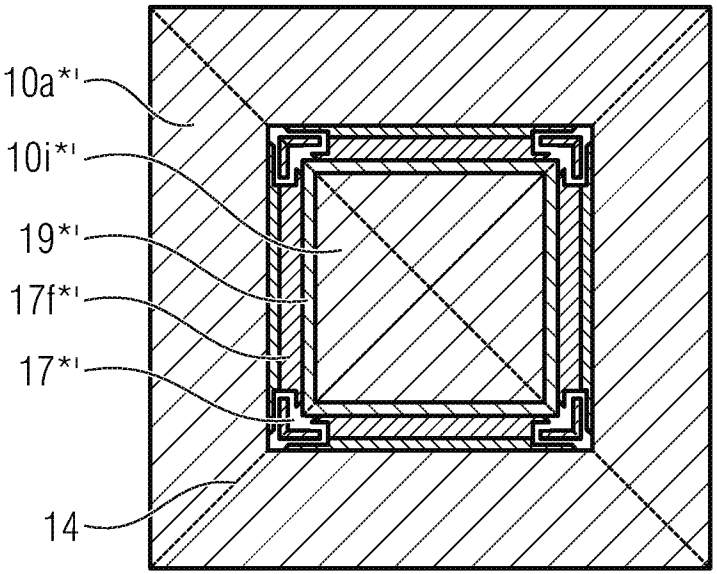

FIG. 8 illustrates the concept of the cascade connection using the example of a specific two-stage design. FIG. 8*a* shows the top view, whereas FIG. 8*b* illustrates a sectional enlargement of the connection area.

As can be seen based on FIG. 8*a*, the two-stage design comprises outer actuators 10*a*' and inner actuators 10*i*'. With respect to the configuration, the design illustrated in FIG. 8*a* may be compared to the design of FIG. 6*a*. In the embodiment illustrated here, the decoupling slits 14 are indicated with solid lines. As can be particularly seen in the enlargement of FIG. 8*b*, respective decoupling slits 14 are also provided between the individual stages.

In contrast to FIG. 6*a*, in the design of FIG. 8*a*, the frame structure 19*'', whose lateral dimensions are smaller than the lateral dimensions of all inside stages 10*e**'', is additionally illustrated.

As can be seen based on FIG. 8*b*, folded springs whose gaps are provided with decoupled filling structures 17*f'', e.g. of a material of the spring or the actuator, serve as connection elements 17*''. Analogously hereto, the gaps 14 between the actuators of both stages comprise such filling structures 17*f''.

Figure 9:
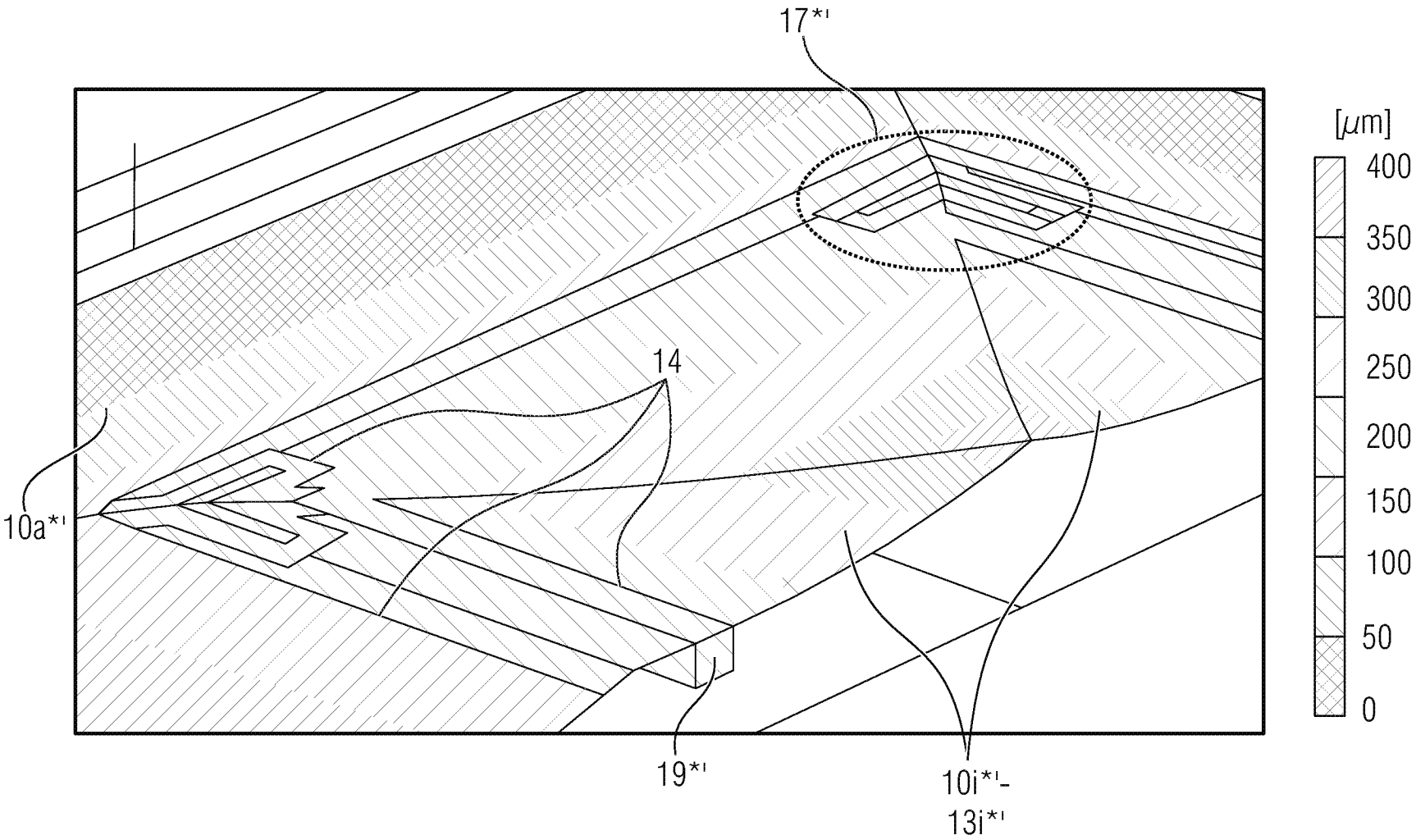
FIG. 9 shows a schematic diagram in order to depict a FEM-simulated deflection of a micromechanical sound transducer with a cascade connection, according to an embodiment.

FIG. 9 shows in a three-dimensional cross section a deflection profile of the example design of FIGS. 8*a* and 8*b*, obtained by means of a FEM simulation. As is shown based on the deflection values illustrated by hatchings, despite the decoupling slits, an approximately continuous deflection profile that is only interrupted by the narrow decoupling slits 14 is formed.

Figure 10B:
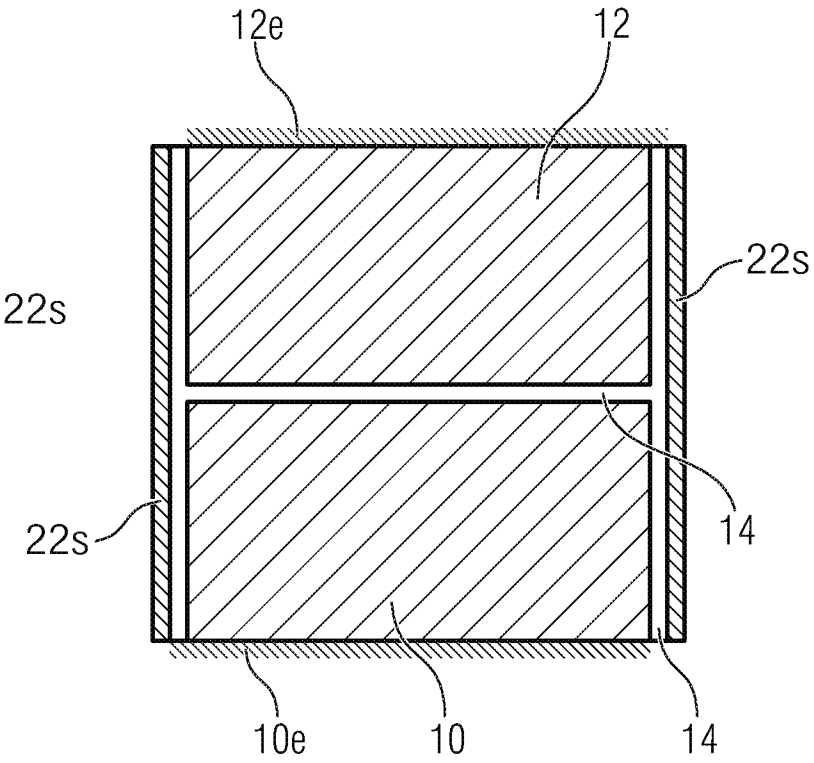
FIGS. 10*a-c* show schematic top views of bending actuators with laterally arranged diaphragm elements, according to embodiments.
Figure 10A:
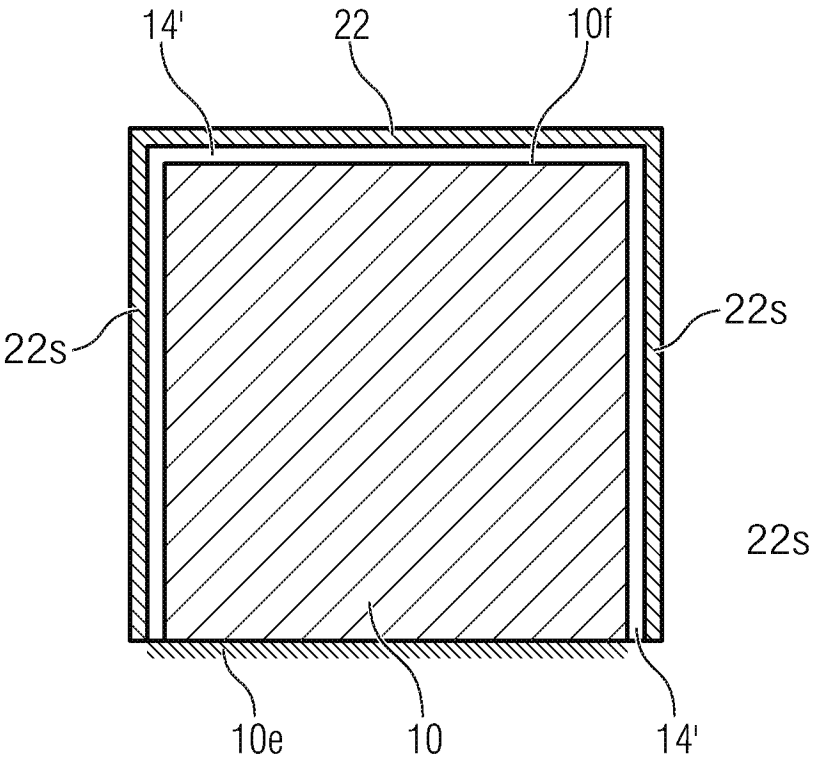

With reference to FIG. 10, an enhancement of the design of FIG. 1*a* and of the design of FIG. 1*b* is described. The configuration of FIG. 10*a* may be compared to the configuration of FIG. 1*b*, wherein the diaphragm element 22 provided opposite to the actuator 10 clamped in on one side (cf. clamping 10*e*) is not only provided in the area of free end 10*f*, but additionally extends along the sides of the actuator, i.e. along the entire decoupling slit 14'. The laterally arranged diaphragm elements are indicated with reference numeral 22*s*.

FIG. 10*b* is based on a sound transducer configuration with two opposite actuators 10 and 12, as is exemplarily shown in FIG. 3*b*. These actuators are each again clamped in on one side (cf. clamping 10*e*, or 12*e*). In this embodiment, a diaphragm element 22*s* arranged vertically extends along the lateral decoupling slits 14.

By using diaphragm elements 22*s* arranged laterally, the embodiment of FIG. 10*a* and the embodiment of FIG. 10*b* allow for a good fluidic separation of the front side and the rear side in the illustrated structures with discontinuous deflection profiles.

Figure 10C:
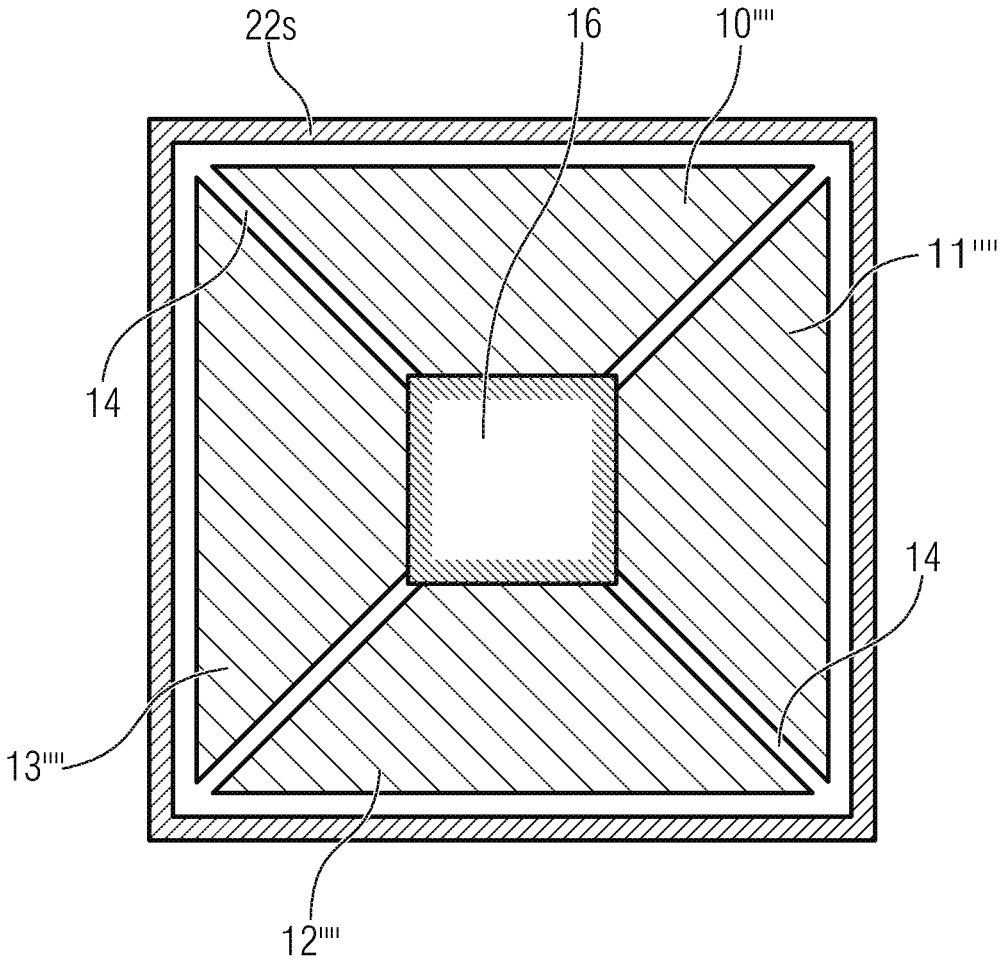

FIG. 10*c* shows a further variation, wherein four actuators 10, 11**, 12** and 13** extend based on a central surface 16. The four actuators 10** to 13** are implemented in a trapezoid shape and are clamped in via their short side on one side opposite to the surface 16. The four actuators 10** to 13** are separated from each other via four diagonally arranged separations slits 14 (which extend as elongations of the diagonal of the surface 16) so that the long side of the actuators 10** to 13** may vibrate freely. In order to enable a "sealing" against the edge areas, a (surrounding) diaphragm element 22***s* implemented vertically is provided along the long side of the trapezoid actuators 10 to 13****.

Figure 12:
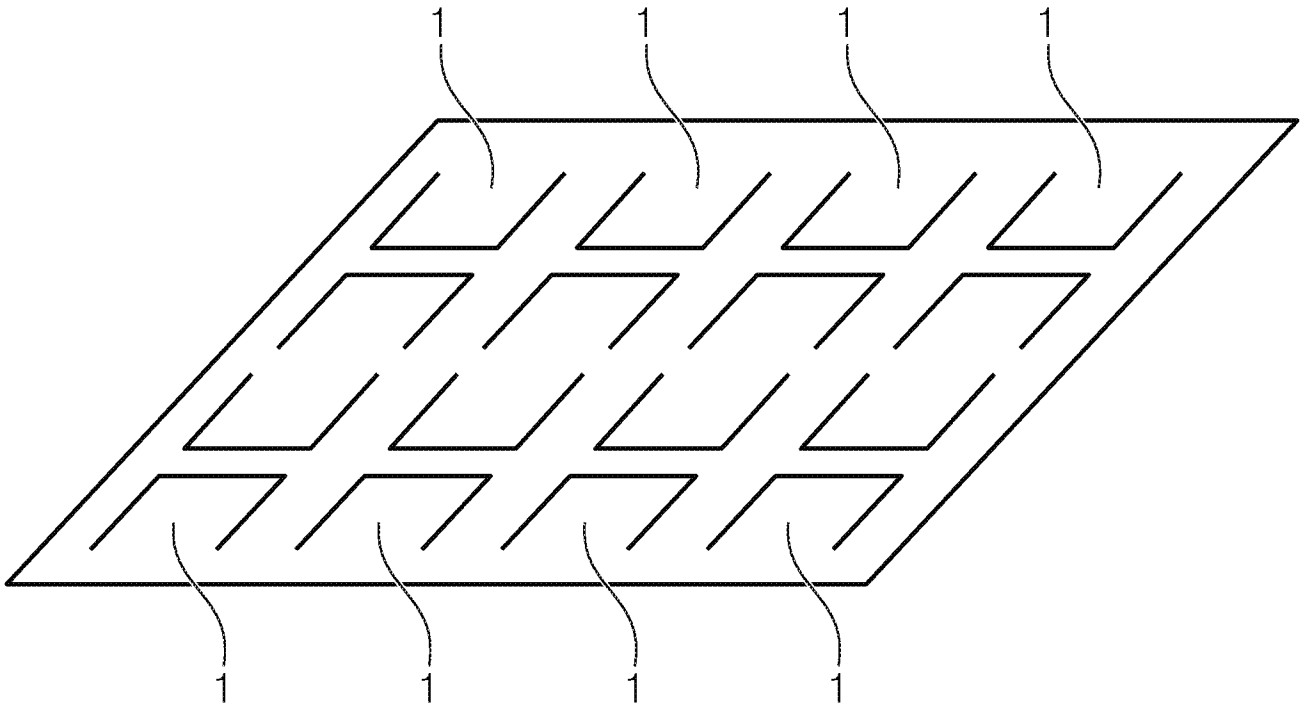
FIG. 12 shows a schematic illustration of an array having a multitude of micromechanical sound transducers according to an embodiment.

FIG. 12 shows a micromechanical sound transducer in the form of an array. The micromechanical sound transducer illustrated here comprises eight sound transducers 1, e.g. as described with reference to FIG. 1*a*. These eight sound transducers 1 are arranged in two rows and four columns. This may achieve a large-surface expansion and therefore a high sound pressure. Assuming that each actuator of the sound transducers 1 has a base area of 5×5 mm, a "membrane area" of 200 $mm^2$ is realized, so to speak. In general, the illustrated sound transducer may be scaled in any way so that sound transducer sizes, e.g., of a length of 1 cm or more (generally in the range of 1 mm to 50 cm) may be achieved.

Although the micromechanical sound transducer 1 of FIG. 12 has been exemplarily described in the embodiment illustrated here, it is to be noted that any other sound transducer as described above may be used, e.g. the sound transducer 1' of FIG. 1*b* or also the cascaded sound transducer of FIG. 5. Different shapes and arrangements are also conceivable.

According to further embodiments, the actuators described individually above may be provided with sensors. The sensors make it possible to determine the actual deflection of the actuators. These sensors are typically connected to the controller of the actuators so that the control signal for the individual actuators is regulated in a feedback loop such that the individual actuators vibrate in-phase. The sensors may also be used to detect non-linearities and to distort the signal in the control such that non-linearities may be compensated, or reduced.

The background for this is that, since the actuators simultaneously form the sound-generating element, aging effects and non-linearities may be directly measured and possibly electrically compensated during operation. This is a large advantage in contrast to conventional membrane-based systems that either have no sensor systems or only allow for the behavior to be detected at the drives but not at the sound-generating membrane element.

Advantageously, the position detection is done via the piezoelectric effect. For this, one or several areas of the piezoelectric layer on the actuators may be provided with separate sensor electrodes via which a voltage signal, or charge signal, approximately proportional to the deflection may be sensed. In addition, several piezoelectric layers may be realized, wherein at least one layer is partially used for the position detection. A combination of different piezoelectric materials that are either arranged above or next to each other (e.g. PZT for actuators, AlN for sensors) is also possible.

As an alternative to piezoelectric sensor elements, the integration of thin film expansion measurement strips (or strain gauges) or additional electrodes for a capacitive position detection is also possible. If the actuator structures are made of silicone, piezoresistive silicone resistors may also be directly integrated.

All of the above-mentioned aspects have in common the creation of a concept for generating large sound pressures that is membrane-less and fully compatible to MEMS manufacturing processes. The optional cascade connection enables the realization of integrated multi-way sound transducers. According to further developments with integrated position sensors, the controller may be configured such that the emitted sound comprises a minimal distortion.

In the subsequent table, possible materials for the individual functional elements may be found.

| Function | Materials |
|---|---|
| piezoelectric layer | PZT, PNZT, AlN, AlScN, ZnO, BCZT, KNN |
| passive layer | Si, poly-Si, SiN, SiNO, $SiO_2$, AlN, metals |
| frame | Si, metals, glass, [piezoelectric layer], [passive layer] |
| diaphragms | Si, metals, glass, polymers, [piezoelectric layer], [passive layer] |
| connection elements | [passive layer], [piezoelectric layer] |

The following dimensions are possible:

actuator surface area: 50×50 $\mu m^2$-5×5 $cm^2$ decoupling slit: 0.1 μm-40 μm deflection amplitude: 0.01 μm-3 mm For example, such transducers may be operated with a first normal mode of 10 Hz to 300 kHz. For example, the excitation frequency is selected statically up to 300 kHz.

The actuator structures described may be used in fields in which sound is to be generated in a frequency range between 10 Hz and 300 kHz with component volumes that are small as possible (<10 $cm^3$). Above all, this applies primarily to miniaturized sound transducers for wearables, smartphones, tablets, laptops, headphones, hearing aids and ultrasonic transducers. Other applications where fluids are displaced (e.g. flow-mechanical and aerodynamic drive and guidance structures, inkjets) may also be considered.

Embodiments provide a miniaturized apparatus for displacing gases and liquids with at least one bending actuator that may be deflected out of the plane, characterized in that the apparatus includes narrow opening slits with a flow resistance of such a magnitude that the apparatus approximately behaves in the acoustic and ultrasound frequency range (20 Hz to 300 kHz) like a closed membrane with respect to fluidics.

According to further embodiments, the apparatus may include: decoupling slits in the actuator materials, whose total length is at most 5% of the total actuator surface area and that have a mean length-to-width ratio of over 10. According to embodiments, the apparatus may additionally be configured such that openings created in the deflected state are smaller than 10% of the total actuator surface area so that, even without a closed membrane, a high fluidic separation between the front side and the rear side may be achieved.

According a further embodiment, the apparatus may comprise two or more opposite separated actuators.

According to a further embodiment, the actuators may be driven in a piezoelectric manner, electrostatically, thermally, electromagnetically or by means of a combination of several concepts. According to an additional embodiment, it would also be conceivable for the apparatus to be configured with two or more actuator stages coupled via connection elements.

According to a further embodiment, it would also be conceivable for the apparatus to comprise two or more actuator stages that are driven with separated signals and therefore form a two-way or multi-way sound transducer.

With reference to the embodiment of FIG. 5 or 6*a* to *c*, it is to be noted that each actuator element 10*a, 12*a, 10*i and 12*i is an active, individually controllable element. For example, it may be operated in a piezoelectric manner or using any other concept described herein.

According to a further embodiment, the apparatus has a frame structure for stiffening and mode-decoupling.

In the above embodiments, the actuators have particularly be described as being actuators that are clamped in on one side. At this point, it is to be noted that two-sided clampings (cf. FIG. 3*d*) or multi-sided clampings in general would be conceivable.

Further embodiments provide an apparatus having flow diaphragms in order to reduce the cross sections of openings between the front side and rear side in the deflected state. According to a further embodiment, the apparatus may comprise sensor elements for position detection and regulation.

According to additional embodiments, the apparatus may be configured for the generation of sound or ultrasound in air (gaseous medium), i.e. in a range of 20 Hz to 300 kHz. Further application fields are the generation and control of air flow, i.e. for cooling.

Subsequently, a possible manufacturing method of the above sound transducers is described with reference to FIG. 11. For example, the embodiment of FIGS. 11*a-d* illustrated here enables the manufacturing of the embodiment shown in FIG. 1*b*. Through slight variations, however, the embodiments of the other drawings, particularly of FIG. 1*a*, may be manufactured using the method illustrated here.

Figure 11A:
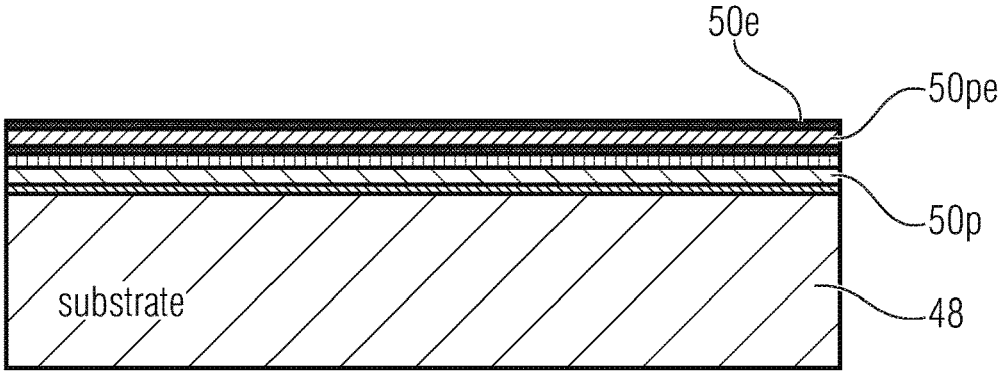
FIGS. 11*a-d* show schematic illustrations in order to depict a process sequence during manufacturing of a micromechanical sound transducer according to embodiments.

In the first step illustrated in FIG. 11*a*, a passive layer 50*p* is applied onto a substrate 48, before providing a piezoelectric layer 50*pe* with two electrodes 50*e*.

The substrate 48 may be a SOI wafer (Silicone on Insulator) including a SI substrate. Then, SiO2 layers 50*p* with insulators 50*pi* indicated in FIG. 11*b* and SI insulation layers, e.g. piezoelectric functional layers (PZT) 50*pe*, are deposited onto the same. Then, the corresponding metal electrodes (Pt, Au, Mo, . . . ) 50*e* may be deposited.

Figure 11B:
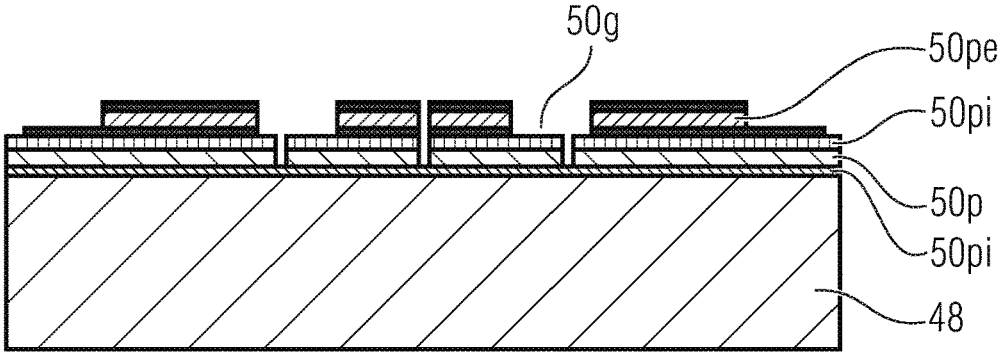

In a next step, which is illustrated in FIG. 11*b*, the electrodes 50*e*, the PZT 50*pe* and the insulation layer 50*p* are then structured. For example, this creates the trenches 50*g* in the piezoelectric layer 50*pe*. Structuring may be done via wet or dry etching. Depending on the desired product design, the step of structuring, or introducing, the trench 50*g* is carried out such that it has only minimal dimensions in order to generate the product of FIG. 1*a*, or such that it has larger dimensions so that the intermediate product illustrated here is then developed with respect to the product of 1*b*.

Figure 11C:
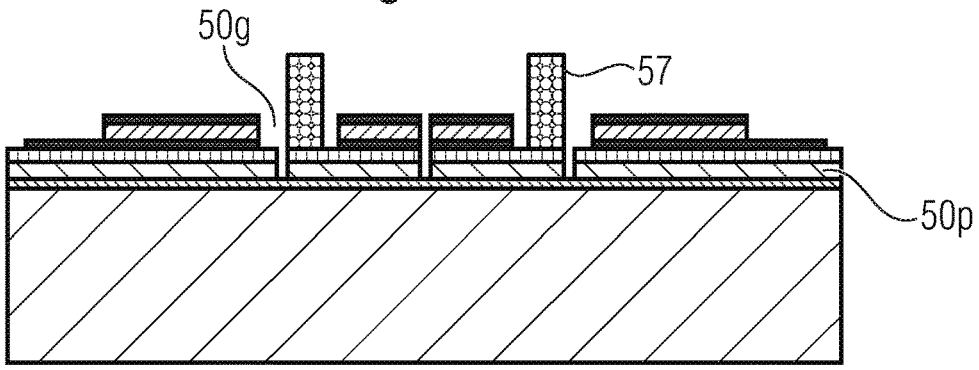
Figure 11D:
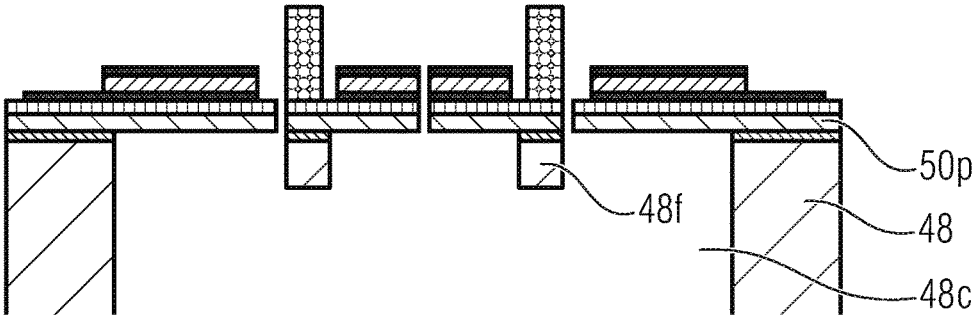

In order to manufacture the product of FIG. 1*a*, a small trench 50*g* is applied and the step illustrated in FIG. 11*c* is then skipped in order to, as is illustrated in FIG. 11*d*, open the rear side by means of a single- or multi-stage etching method and to release the movable structures. In this step, the substrate is removed below the passivation layer 50*p* in particular in the area aligned with the structured piezoelectric actuators 50*pe*. This creates the cavity 48*c*.

In order to manufacture a product as is described with reference to FIG. 1*b*, the optional step illustrated in FIG. 11*c* is performed. FIG. 11*c* illustrates applying the vertically extending diaphragm elements 57. These are introduced into the trenches 50*g* of the piezoelectric layer 50*pe*. Optionally, the lateral position of the trenches 57 may be selected such that they are aligned with areas of the structured passivation layer 50*p*, so that, e.g., the vertical diaphragm element 75 elongates the wall of a trench in the passive layer 50*p*. For example. applying the diaphragm elements 57 may be done by galvanic deposition, and advantageously such that the diaphragm elements 57 extend beyond the layer of the piezoelectric elements 50*p*.

After applying the diaphragm elements 75, as described above with respect to the embodiment of FIG. 1*a*, the single- or multi-stage etching of the rear side of the substrate 48 is carried out in order to manufacture the cavity 48*c*. As is illustrated here, individual areas of the substrate 48 may remain so that the frame 48*f* is formed within the cavity 48*c*. For example, this frame corresponds to the frame 19 described in FIG. 5.

MEMS technologies may be adopted in the manufacturing steps described above so that the above-described product may be manufactured with conventional manufacturing methods.

Although some aspects have been described in connection with an apparatus, it is noted that these aspects also represent a description of the corresponding method so that a block or a component of an apparatus is also to be understood as a corresponding method step or as a feature of a method step. Analogously thereto, aspects that were described in connection with a or as a method step are also a description of a corresponding block or a detail or a feature of a corresponding apparatus.

Subsequently, based on the basic embodiment of FIG. 1*b*, different implementations of the diaphragm 22 are described. In all subsequently discussed embodiments, it is assumed that the discussed diaphragm 22*, 22$^{etc}$ is separated from the bending actuator 10 (fixedly clamped in at the reference point 10*e*) with a slit 14' so that the free end 10*f* of the bending actuator 10 may move along the vertical expansion of the diaphragm element 22* or 22$^{etc}$. Here, it is to be noted that aspects of the subsequently discussed embodiments, or of the above-discussed embodiments, for the diaphragm may be combined with each other (e.g. lid with rounded/slanted sides (diaphragms)) or asymmetrical diaphragm with lid and stop . . . ).

Figure 13A:
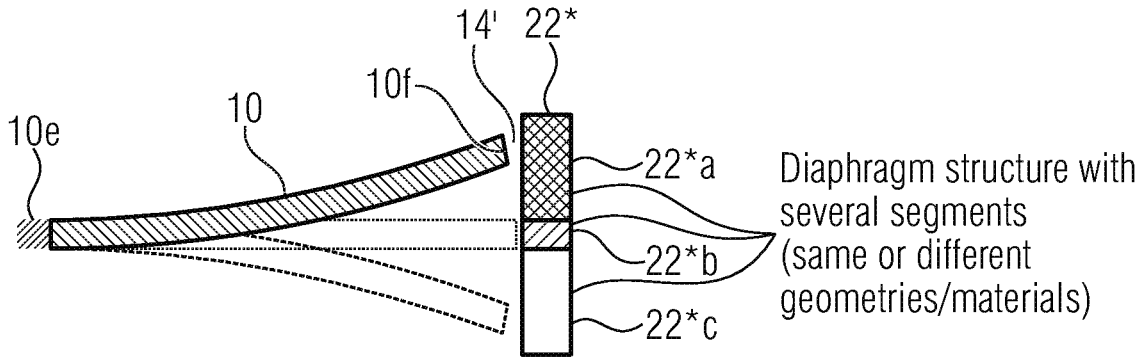
FIGS. 13*a-i* show schematic illustrations of different implementations of the diaphragm structures described in FIG. 1*b*, according to embodiments.

FIG. 13*a* shows a schematic cross section of a diaphragm structure. It can be seen that the diaphragm structure 22* consists of several segments 22*a, 22*b and 22*c. The segment 22*a extends from the substrate plane (plane of the reference point 10*e*), in which the bending actuator 10 is in its idle state, for example, out of the substrate, whereas the segment 22*b is located in said plane of the reference point 10***e*. The segment 22*c is located in the substrate, or extends from the substrate surface into the substrate. According to embodiments, all illustrated segments 22*a, 22*b, 22*c may comprise different geometries, i.e. lengthwise expansions and crosswise expansions as well as variable cross sections. According to embodiments, it would further be conceivable for the individual segments 22*a, 22*b and 22*c to comprise different materials or material implementations. For example, the segments 22*c and 22*b may be formed by the substrate itself, whereas the segment 22*a could be grown.

According to further embodiments, it would also be conceivable to provide more than the three illustrated segments 22*a, 22*b and 22*c**.

In the above and subsequent embodiments, it is to be noted that the middle position does not necessarily have to correspond to the idle state, but may also be shifted upwards or downwards in any way (electrically or mechanically biased).

Figure 13B:
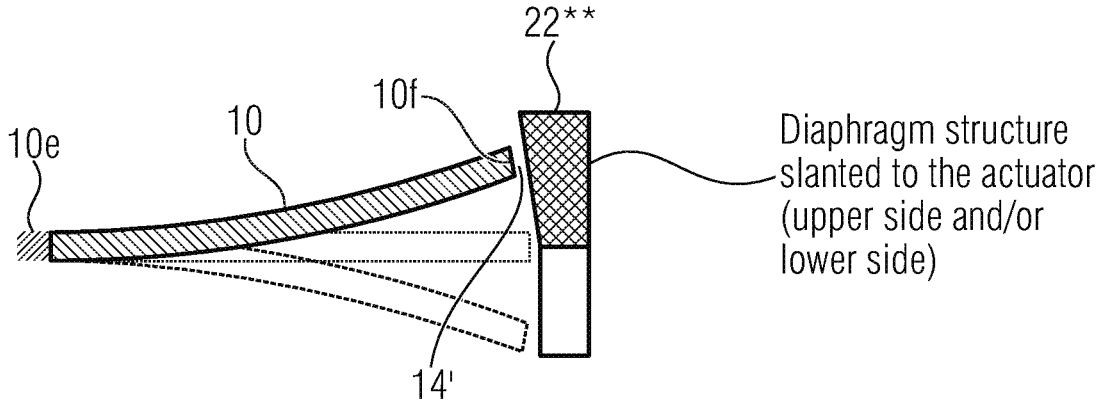

FIG. 13*b* shows a further implementation of the diaphragm structure, here the diaphragm structure 22. The diaphragm structure 22", or in particular the segment that extends out of the substrate plane, comprises a slanted cross section that extends towards the actuator 10. This achieves that the slit 14' comprises a relatively constant width regardless of the position of the actuator 10. The background for this is that the side of the diaphragm structure 22** directly opposite to the actuator 10 extends approximately along the movement path (circular path around the fixed point 10***e*). As is illustrated here in FIG. 13*b*, the diaphragm 22 may be slanted either only towards the upper side and/or only towards the lower side. The illustrated asymmetrical structure is only an example, i.e. the lower segment of the diaphragm structure 22**** may obviously also be analogously slanted in order to achieve a symmetrical structure.

This embodiment of the diaphragm structure 22** with the slanted inner side has the advantage that a slit expansion may be decreased, or compensated, at larger amplitudes. From a manufacturing perspective, the slanting may be realized by adapting the lacquer profile or the etching process.

Figure 13C:
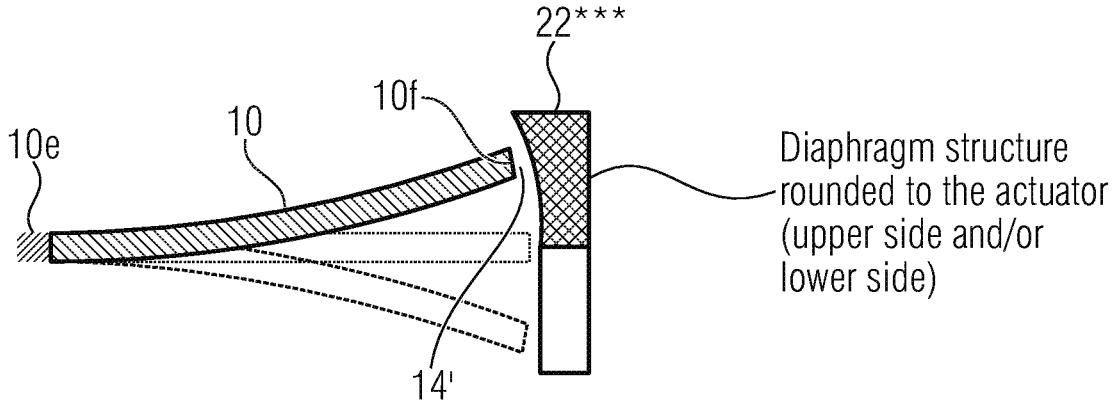

FIG. 13*c* shows a further development of the diaphragm structure 22 of FIG. 13***b*, i.e. the diaphragm structure 22* . The diaphragm structure 22*** comprises a curved/rounded inner side. This rounding extends along the circular arc-shaped movement path of the actuator 10, or of the free end 10***f* of the actuator 10. Although the rounded inner side is illustrated here only on the side extending out of the substrate, this rounded inner side may obviously also be present on the diaphragm structure side in the substrate plane. Analogously to the embodiment of FIG. 13*b*, the slit expansion is decreased, or compensated, at larger amplitudes by the diaphragm structure 22*** with the rounded inner side. From a manufacturing perspective, the rounding may be achieved by adapting the lacquer profile or the etching profile, for example.

Figure 13D:
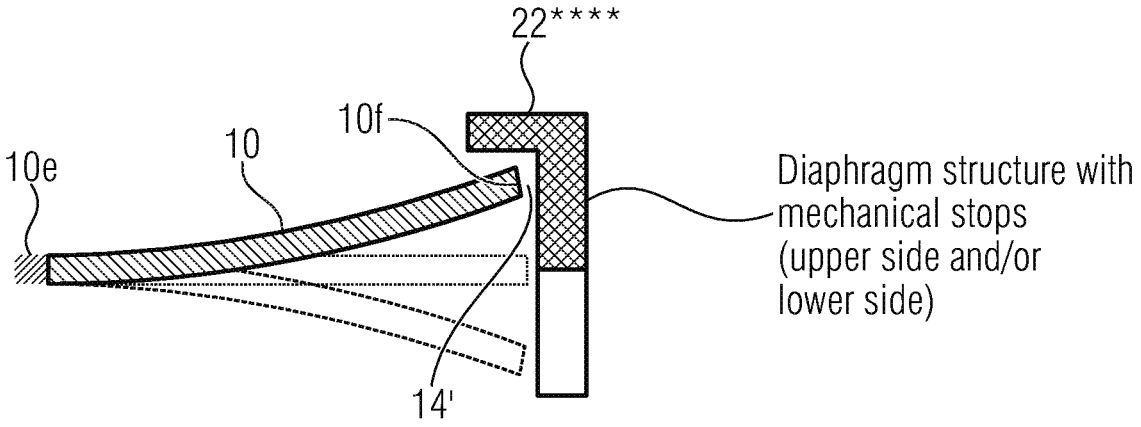

FIG. 13*d* shows a further diaphragm structure, i.e. the diaphragm structure 22**. Here, the cross section at the end of the diaphragm structure 22**** comprises a widening, or an overhang, that serves as a mechanical stop for the actuator 10, or the free end 10***f* of the actuator. Advantageously, this stop enables a mechanical overload protection.

Figure 13E:
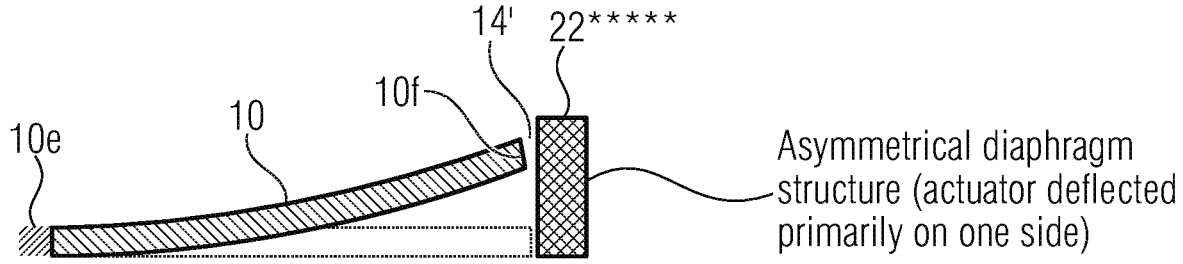

FIG. 13*e* shows a further diaphragm structure 22***, where the diaphragm structure 22***** is structured asymmetrically. The background for this is that there are actuators 10 that are primarily deflected on one side so that a vertical expansion of the diaphragm 22***** reaches into one direction, here a direction out of the substrate plane. Although the deflection of the actuator 10, or the expansion of the diaphragm structure 22*******, is illustrated here as being upwards (out of the substrate plane), according to embodiments, this may obviously also be the reverse, i.e. such that both elements extend into the substrate. It is to be noted that the shift of the idle position of the actuator may be realized by an electrical offset in the drive signal or a mechanical projection (e.g. layer stress in actuator layers).

Figure 13F:
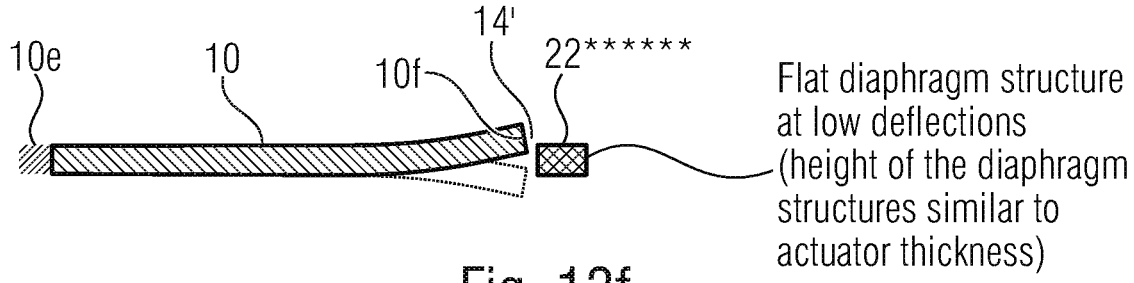

FIG. 13*f* shows an example of a diaphragm structure 22**** having a small expansion. The diaphragm structure 22****** may be realized to be flat if the deflection of the actuator 10 is small. For example, the height expansion of the diaphragm 22******** is in the range of the actuator thickness. This variation has advantages with respect to manufacturing since additionally applied diaphragm structure regions may be omitted.

Figure 13G:
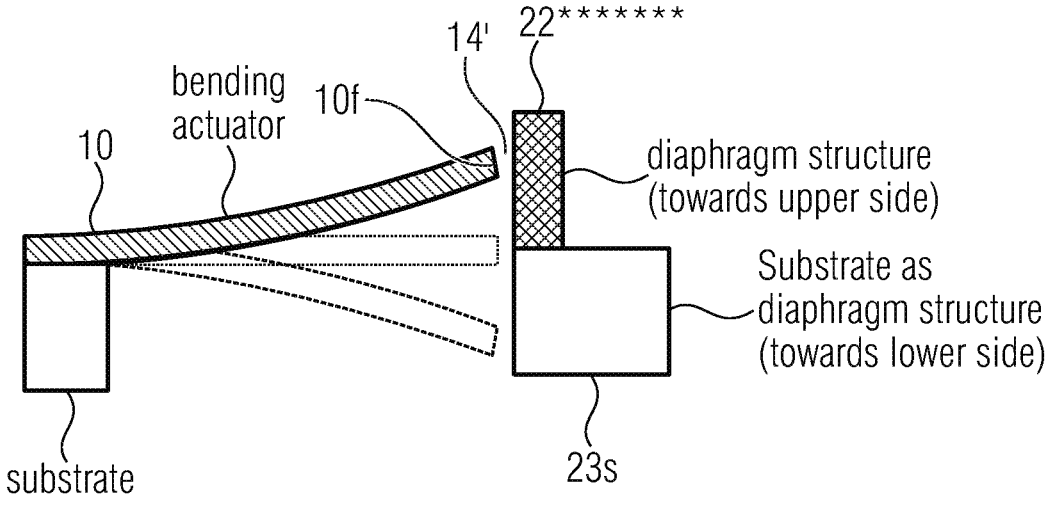

FIG. 13*g* shows an example of a diaphragm structure 22***** that consists of a substrate region 23***s* and the actual diaphragm element 22****. For example. the upper diaphragm structure 22******* may be manufactured as a galvanically structured metal or as a polymer (SU8, BCB, . . . ) or also from glass or silicone. The lower diaphragm structure 23***s* primarily consists of the substrate (e.g. silicone or glass) itself and may be provided with additional layers, according to further embodiments.

Figure 13H:
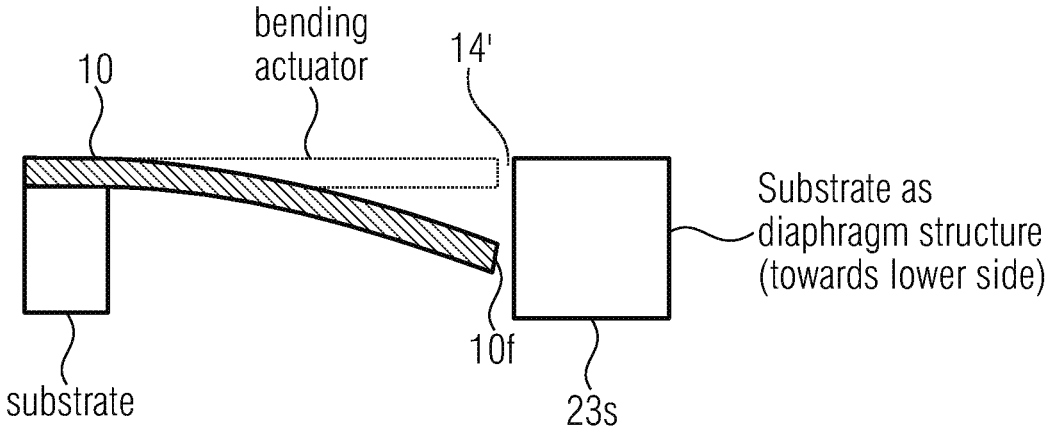

FIG. 13*h* shows a further diaphragm structure without an additionally applied element. Here, it is assumed that the bending actuator 10 vibrates particularly into the substrate plane so that a diaphragm element extending out of the substrate plane may be omitted. Thus, the diaphragm element consists here of the substrate element 23*s* that forms the lower diaphragm structure. At this point, it is to be noted that, as explained above, the idle position of the actuator 10 may be shifted downwards via mechanical bias or electrical offset so that the diaphragm element 23*s* formed here is sufficient. In operation, the actuator may only be deflected downwards so that there is no need for a diaphragm towards the upper side, and the manufacturing effort may be reduced.

Figure 13I:
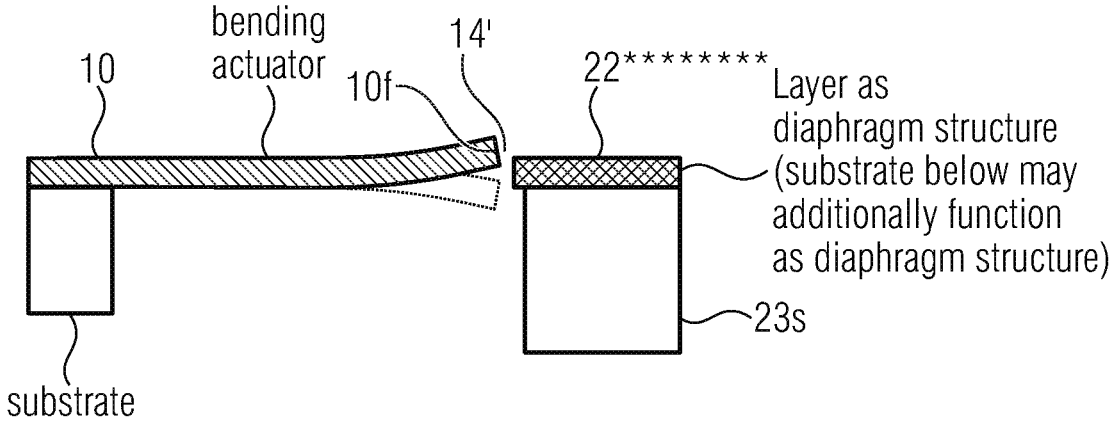

FIG. 13*i* shows a further diaphragm structure 22****** that essentially consists of a thin layer applied to the substrate element 23***s*. Depending on the desired actuator deflection, the layer thickness of the diaphragm element 22****** may be in the range of the actuator thickness. The substrate 23***s* may (but does not have to) additionally function as a diaphragm structure and may be flush with the diaphragm structure 22******** or comprise an offset.

Figure 14A:
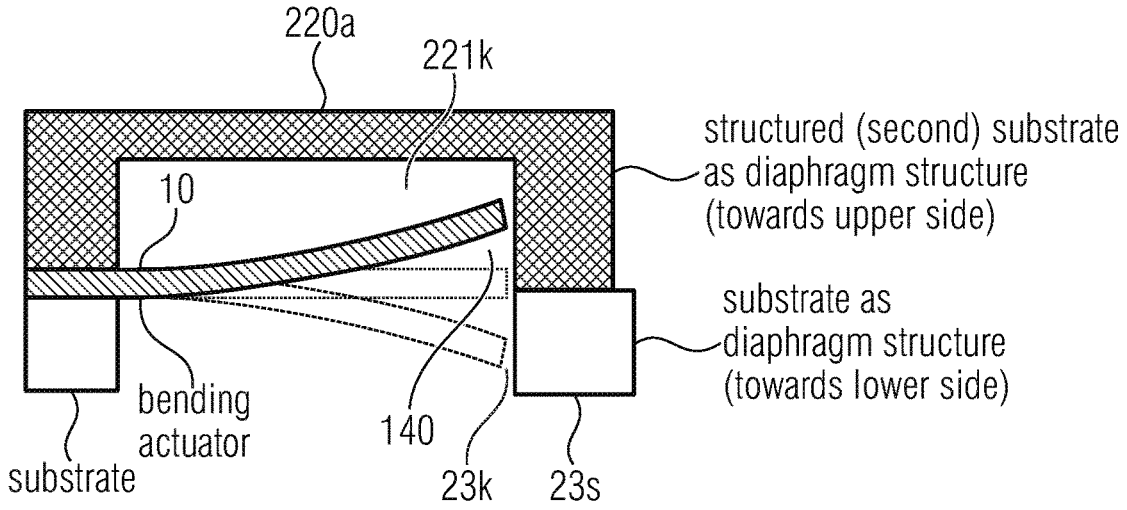
FIGS. 14*a-c* show schematic illustrations of micromechanical sound transducers with a lid, according to additional embodiments.
Figure 14B:
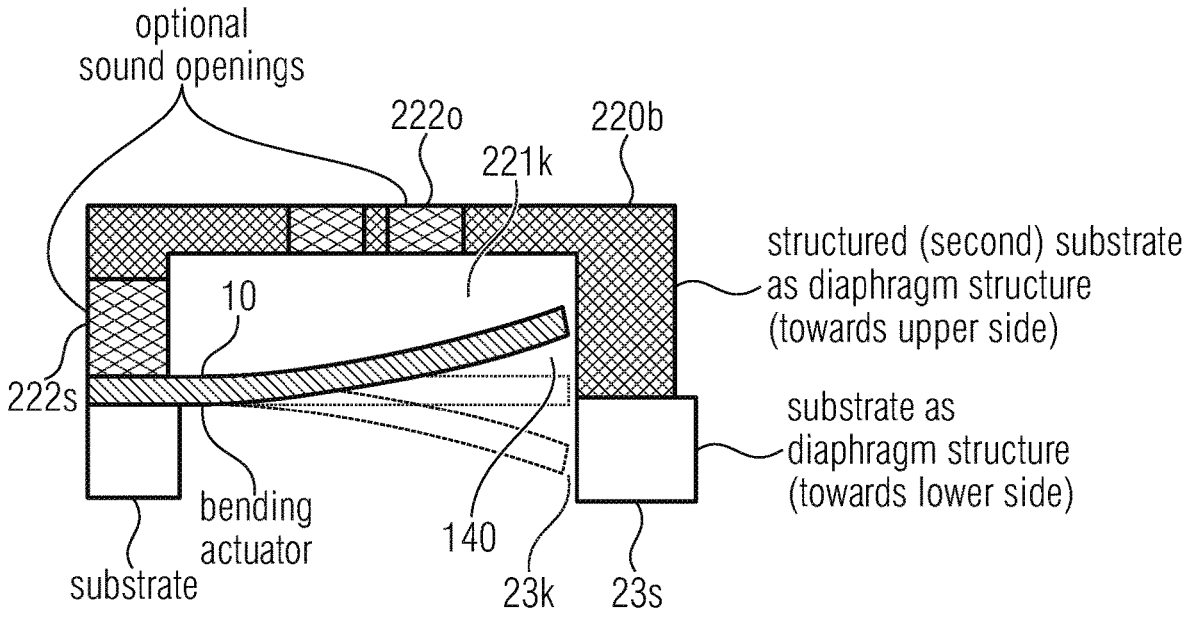
Figure 14C:
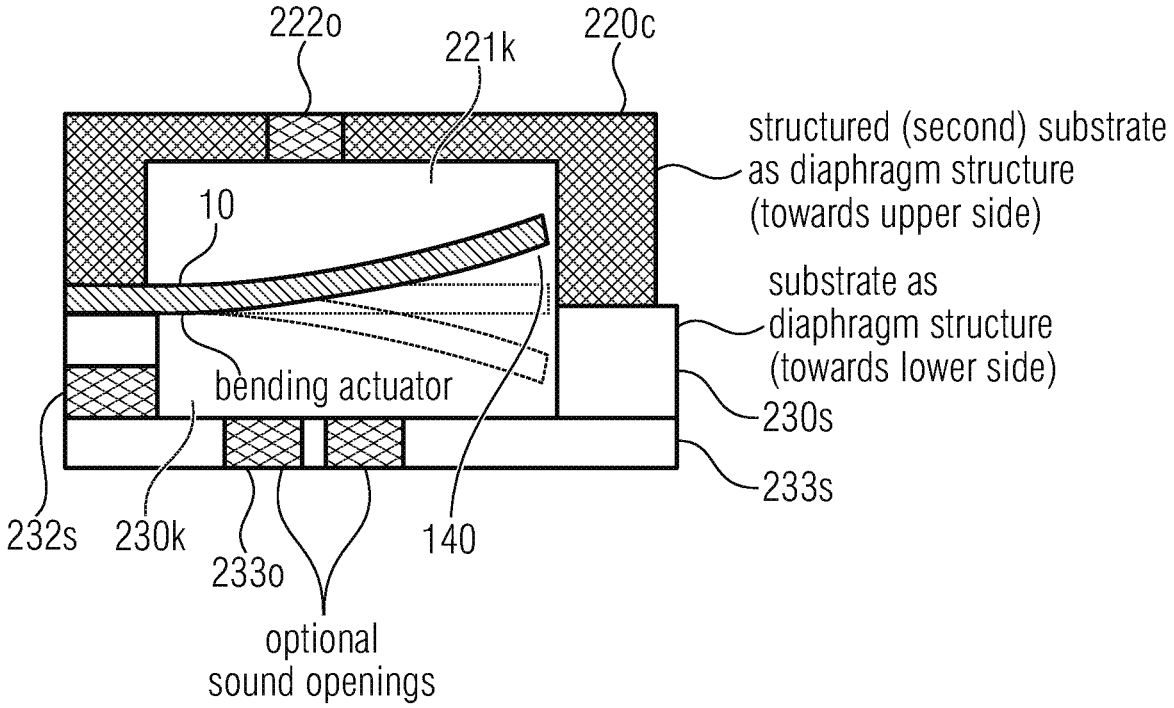

Further embodiments are described with respect to FIGS. 14*a* to 14*c*, where the micromechanical sound transducer is enhanced by a further substrate 220*a*, 220*b* and 220*c* (lid).

According to embodiments, the further substrate 220*a*, 220*b*, 220*c* forms the diaphragm structure.

FIG. 14*a* shows a substrate 220*a* configured as a lid that is placed onto a substrate 23*s* above a cavity 23*k* of the bending actuator 10 so that the bending actuator 10 may vibrate within the lid 220*a*, or within the room defined by the inner lid space 220*a* and the cavity 23. The lid 220*a* is arranged at the side opposite to the free end such that the inner side wall of the lid 220*a* is separated from the end 10*e* by the slit 140. Since the lid 220*a* is fully closed in this embodiment, the bending actuator 10 emits sound through the cavity 23*k*, for example.

In this embodiment, it is to be noted that in all above embodiments, or their descriptions, it is essentially assumed that the sound is emitted out of the substrate. Obviously, according to embodiments, it is also conceivable that the sound is led out through the substrate, or through a cavity of the substrate.

At this point, it is to be noted that FIG. 14*a* illustrates a cross section through the substrate 220*a*, wherein the further substrate extends, e.g., in a circular-shaped or angular manner around the bending actuator 10 in order to provide a (rear) volume or generally a cover for the same. From a manufacturing perspective, it is to be noted that the lid 220*a* may be manufactured by a second structure substrate (i.e. a substrate having a cavity) (cf. reference numeral 221*k*), for example. This second substrate is then applied onto the substrate having the bending actuator 10 so that the cavity 221*k* is flush with the cavity 23 at least in regions (in the area of the slit 140).

FIG. 14*b* shows a further embodiment with a modified lid 220*b*, wherein the remaining structure corresponds to the same actuator 10 and the substrate 23*s*. The lid 220*b* differs from the lid 220*a* in that it comprises optional sound openings 222*o* or 222*s*. The sound opening 222*o*, or the several sound openings 222*o*, is/are applied onto the main surface on the lid 220*b*, whereas the opening 222*s* is provided laterally. According to embodiments, it is to be noted that it is also sufficient if one opening is provided, either the opening 222*o* or the opening 222*s*. The enclosed air volume in the cavity 221*k* may be ventilated by means of these openings 222*o*, or 222*s*. The openings may be used for the sound to exit or may enable a pressure equalization. Several openings may together form one or several grid structures that protect the actuator against mechanical influences and dust.

FIG. 14*c* shows a further sound transducer with a lid 220*c* having an opening 222*o*. The bending actuator is provided on a further substrate 230*s* that comprises a lateral opening 232*s*. The substrate 230*s* is applied onto a further substrate 233*s*, or a lid 233*s*, so that the cavity 230*k* is closed. This further substrate 233*s* may also comprise optional sound openings 233*o*. This makes it possible to form a volume that is closed, or ventilated through at least one of the optional openings 232*s*, 233*o*, 222*o*. The volume is essentially formed by the cavities 221*k* and 230*k* and is open via at least one or several openings. The openings may be used for the sound to exit or enable a pressure balance. Several openings may cooperate and form one or several grid structures that protect the actuator 10 against mechanical influences and dust.

Subsequently, different actuator geometries that are enhanced compared to the geometries of FIG. 10 are described with reference to FIGS. 15*a* to 15*h*. In illustrations, the actuator is provided with reference numerals 100, or 100_1 to 100_4, whereas the diaphragm is provided with reference numeral 225. A coupling slit provided with reference numeral 140 extends between the actuator and the diaphragm.

Figure 15A:
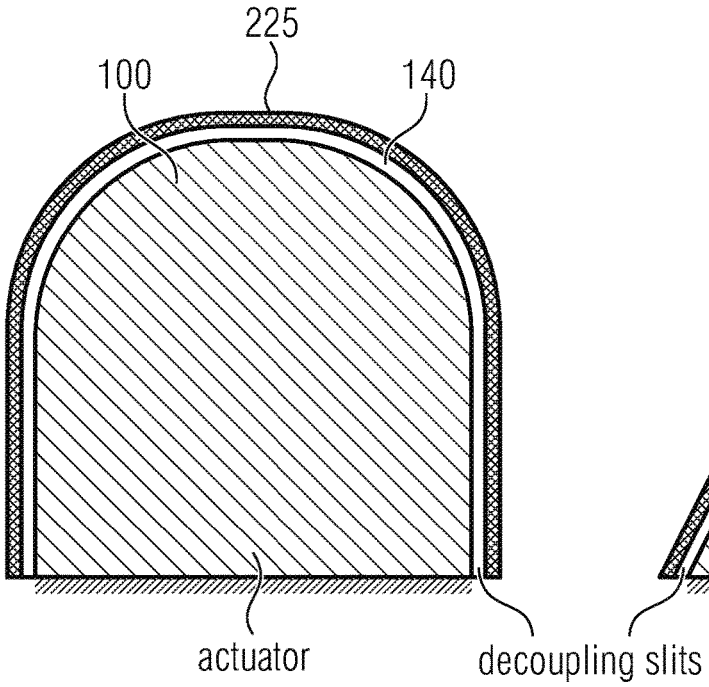
FIGS. 15*a-h* show schematic illustrations of top views of micromechanical sound transducers according to embodiments.
Figure 15B:
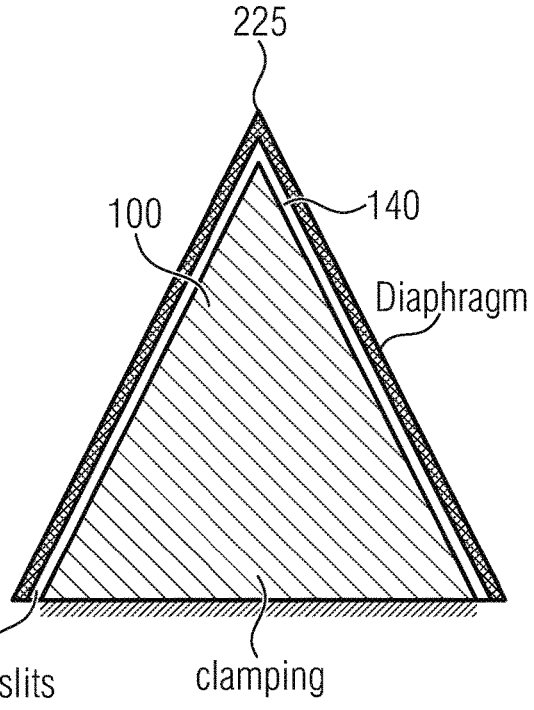
Figure 15C:
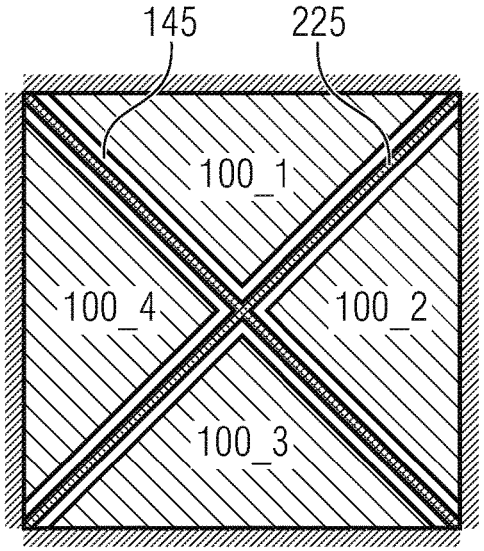
Figure 15D:
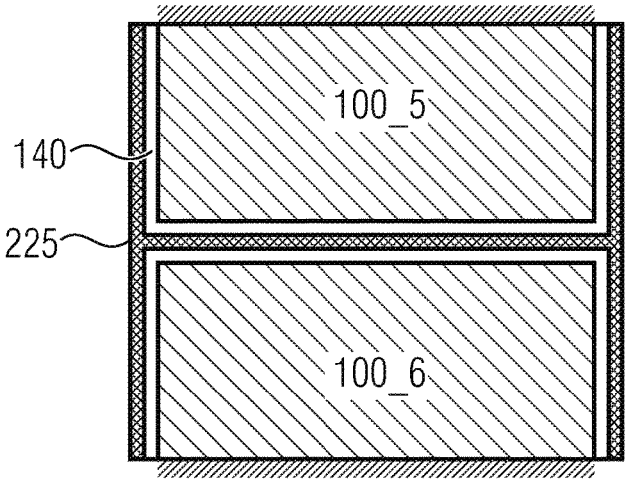
Figure 15E:
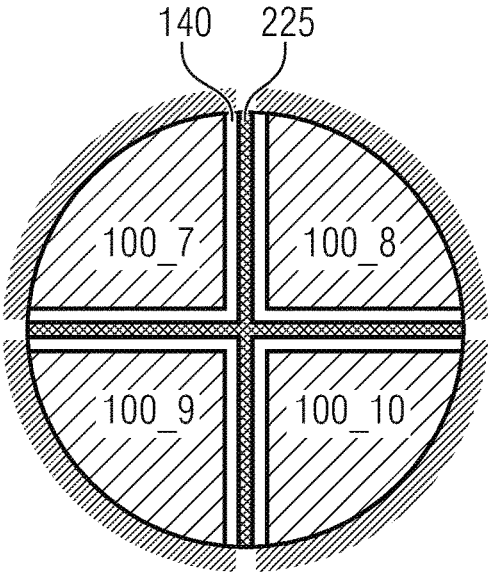
Figure 15F:
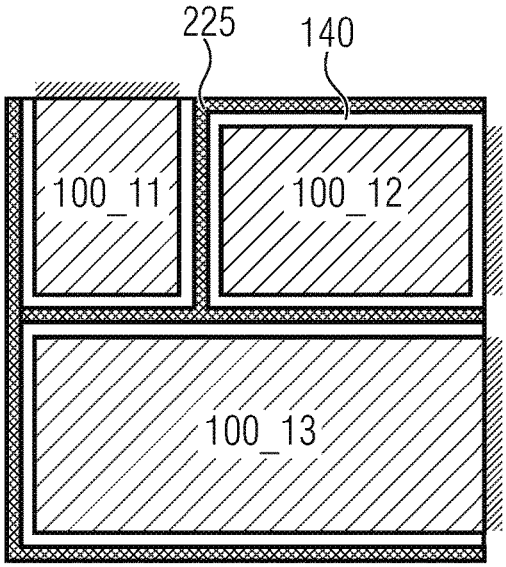

In embodiments, it is to be noted that the actuator geometries may be combined in any way (e.g. FIG. 15*f* with rounded or triangular actuators).

FIG. 15*a* shows a top view of a rounded actuator 100, whereas FIG. 15*b* shows a top view of a triangular actuator 100. The same or different actuators 100 may be combined in any way, as is exemplarily shown based on FIGS. 15*c*, 15*d* and 15*e*.

FIG. 15*c* shows triangular actuators 100_1 to 100_4 that together describe a rectangular surface area, wherein the four actuators 100_1 to 100_4 are separated by a diaphragm structure 225 that is arranged in a cross-shaped manner. The slit 145 is again provided between the actuators 100_1 to 100_4 and the diaphragm structure 225. Alternatively, arrangements with 3, 5, 6 . . . actuators would also be conceivable. Furthermore, it is to be noted that the total surface area does not necessarily have to be rectangular, but may also be polygonal.

FIG. 15*d* shows two opposing rectangular actuators 100_5 and 100_6 describing a rectangle. The rectangular actuators 100_5 and 100_6 each form three free ends that are limited by the H-shaped diaphragm 225 with the associated slit 140.

FIG. 15*e* shows four cross segment-shaped actuators 100_7 to 100_10 that are separated by a cross-shaped diaphragm 225 having a slit 140, similar to FIG. 15*c*. In the variation of FIG. 15*c*, the hypotenuse of each triangular actuator 100_1 to 100_4 is clamped in, whereas, in the embodiment of FIG. 15*e*, each cross-segment arc 100_7 to 100_10 is fixedly clamped in. Alternatively, arrangements with 3, 5, 6 . . . actuators would also be conceivable. In addition, it is to be noted that a total surface area does not necessarily have to be rectangular, but may also be polygonal.

Figure 15G:
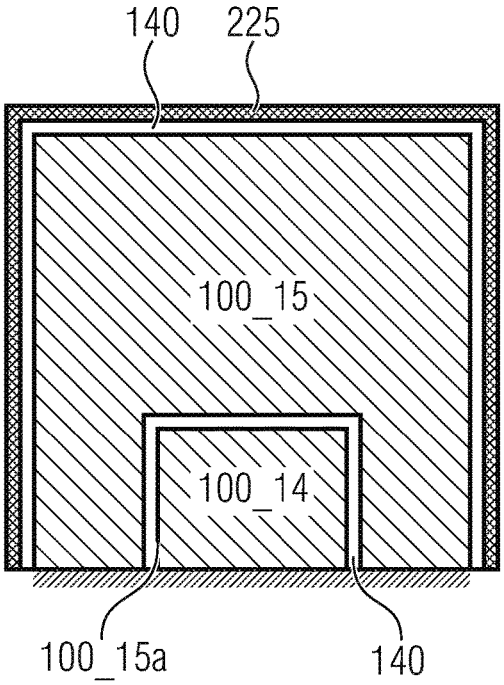
Figure 15H:
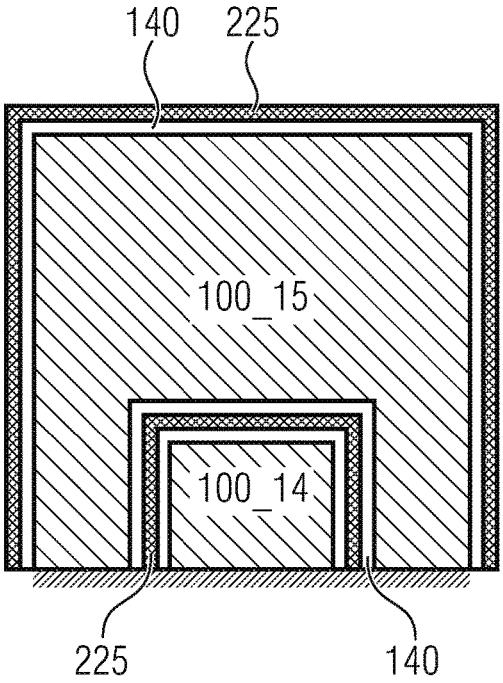

By combining different actuators, e.g., multi-way systems may be realized, as is shown based on FIG. 15*f*, FIG. 15*g* and FIG. 15*h*.

For example, FIG. 15*f* combines three differently shaped but rectangular actuators 100_11 to 100_13 each clamped in on one of the four sides, wherein three of the four sides form free ends. A maze-shaped diaphragm 225 that separates the actuators 100_11 to 100_13 using the slits 140 is provided between the free ends. For example, all actuators 100_11 to 100_13 have different sizes (surface area) and may therefore be configured for different frequency ranges.

FIG. 15*g* shows two actuators 100_14 and 100_15, wherein the first actuator 100_14 is a rectangular small actuator. The larger actuator 100_15 is also rectangular, however, comprises a recess 100_15*a* for the other actuator 100_14. The recess 100_15*a* is arranged such that the two actuators are clamped in on the same side. These actuators 100_14 and 100_15 may be decoupled in their movement by means of a slit 140 provided between the two actuators 100_14 and 100_15. For example, the larger actuator 100_15 may be used for the low tonal range, whereas the inner actuator 100_14 may be used for the high tonal range.

FIG. 15*h* shows a similar structure of the actuators 100_14 and 100_15, wherein a further diaphragm 225 is provided in addition to the separation by means of the slit 140 of the two actuators 100_14 and 100_15. Both embodiments (FIG. 15*g* and FIG. 15*h*) have in common that the diaphragms 225 including the slit 140 are arranged at least along the free ends of the larger actuator 100_15 having the recess 100_15*a* in which the small actuator 100_14 is arranged. Such an inner interleaved arrangement, or provision, of larger and smaller actuators makes it generally possible to cover different frequency ranges with different actuators.

Figure 16:
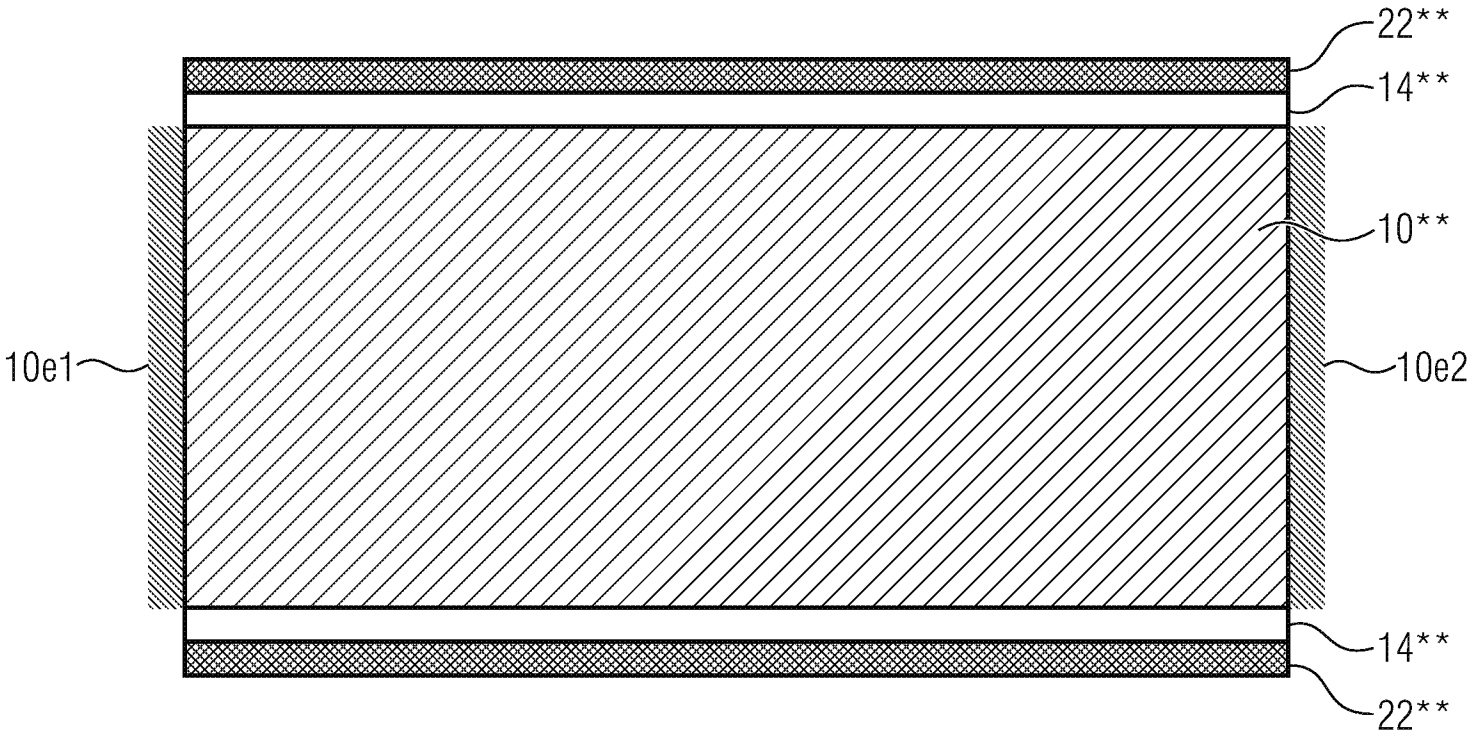
FIG. 16 shows a schematic illustration of a micromechanical sound transducer clamped-in on two sides, according to embodiments.

FIG. 16 shows a schematic top view of a bending actuator 10 clamped in on two sides or on several sides (cf. regions 10*e*1 and 10*e*2), comprising at least one free side 10*f* (here 2). As explained above, this free side 10*f* may be acoustically separated by means of an opposite diaphragm 22** (here 2, according to the described variations) with a slit 14**** positioned therebetween.

In the above embodiments, it was particularly assumed to provide a sound transducer for the emission of sound (loudspeaker), which is why the term "bending actuator" was used. Obviously, this principle may also be reversed so that the sound transducer according to an embodiment forms a microphone, wherein the bending transducer (cf. bending actuator) is configured to be excited, e.g. by air, in order to (e.g. vertically) vibrate to output an electrical signal (generally to detect the acoustical waves of the surroundings). A further embodiment creates a device that includes a loudspeaker and a microphone on the basis of the above-described concepts. Here, the two devices may be formed on the same substrate which is also of advantage from a manufacturing perspective.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

BIBLIOGRAPHY

[Hou13] Houdouin et al, Acoustic vs electric power response of a high-performance MEMS microspeaker, IEEE SENSORS 2014

[Dej12] Dejaeger et al. Development and Characterization of a Piezoelectrically Actuated MEMS Digital Loudspeaker, Procedia Engineering 47 (2012) 184-187

[Gla13] Glacer et al., Reversible acoustical transducers in MEMS technology, Proc DTIP 2013,

[Yi09] Yi et al., Performance of packaged piezoelectric microspeakers depending on the material properties, Proc. MEMS 2009, 765-768

The invention claimed is:

1. A micromechanical sound transducer for emitting sound, being set up in a substrate, comprising:

a first bending transducer that extends along a plane of the substrate and comprises a free end or a free side and is configured to be excited to vibrate vertically in order to emit a sound; and a diaphragm element extending vertically to the first bending transducer, the diaphragm element being separated from the free end or the free side of the first bending transducer via a slit;

wherein the slit is smaller than 5% or smaller than 1% or smaller than 0.1% or smaller than 0.01% of the surface area of the first bending transducer and wherein, upon a deflection, the slit is smaller than 10%, 5%, 1%, 0.1% or 0.01% of the surface area of the first bending transducer.

2. A micromechanical sound transducer set up in a substrate, comprising:

a first bending transducer that extends along a plane of the substrate and comprises a free end or a free side and is configured to be excited to vibrate vertically in order to emit or receive a sound; and a diaphragm element extending vertically to the first bending transducer, the diaphragm element being separated from the free end or the free side of the first bending transducer via a slit;

wherein the micromechanical sound transducer comprises a lid that is placed onto the substrate in the area of the first bending transducer so that at least the first bending transducer and the diaphragm element are covered by the lid or the first substrate, and wherein the lid forms the diaphragm element.

3. The micromechanical sound transducer according to claim 1, wherein the diaphragm element extends out of the plane of the substrate.

4. The micromechanical sound transducer according to claim 3, wherein the diaphragm element extends out of an immobile region of the substrate.

5. The micromechanical sound transducer according to claim 1, wherein the first bending actuator may be excited to vibrate out of the plane of the substrate, or may be excited to vibrate perpendicularly to the plane of the substrate.

6. The micromechanical sound transducer according to claim 1, wherein the height of the diaphragm element amounts to at least 50% or at least 100% of the maximum deflection of the first bending transducer in linear operation or of the maximum elastic deflection of the first bending actuator or to at least 3-times a width of the slit or at least 1-time a thickness of the bending transducer or to at least 0.1% or 1% of the length of the bending transducer.

7. The micromechanical sound transducer according to claim 1, comprising a diaphragm element vertically extending to the first bending transducer, the diaphragm element being separated from the movable sides of the first bending transducer via a slit.

8. The micromechanical sound transducer according to claim 1, wherein the diaphragm element comprises in its cross section a varying geometry.

9. The micromechanical sound transducer according to claim 8, wherein the geometry varies such that a surface area facing the bending transducer along a movement path of the free end is curved or tilted when the bending transducer vibrates vertically.

10. The micromechanical sound transducer according to claim 8, wherein the diaphragm element comprises a mechanical stop for the bending transducer.

11. The micromechanical sound transducer according to claim 1, wherein the diaphragm element extends asymmetrically out of the plane of the substrate and into the plane of the substrate.

12. The micromechanical sound transducer according to claim 1, wherein the diaphragm element extends symmetrically out of the plane of the substrate and into the plane of the substrate; and/or wherein, based on the idle position of the bending transducer, the diaphragm element comprises a same height expansion out of the plane of the substrate and into the plane of the substrate.

13. The micromechanical sound transducer according to claim 1, wherein the substrate forms the diaphragm element or a part of the diaphragm element within the substrate.

14. The micromechanical sound transducer according to claim 1, wherein the micromechanical sound transducer comprises a lid that is placed onto the substrate in the area of the first bending transducer so that at least the first bending transducer and the diaphragm element are covered by the lid or the first substrate.

15. The micromechanical sound transducer according to claim 14, wherein the lid forms the diaphragm element.

16. The micromechanical sound transducer according to claim 14, comprising one or several openings in the lid; and/or wherein the micromechanical sound transducer comprises one or several sound openings in the substrate.

17. The micromechanical sound transducer according to claim 1, wherein the micromechanical sound transducer comprises a second bending transducer with a free end, the second bending transducer being arranged in a mutual plane with the first bending transducer, and wherein the diaphragm element is arranged between the free end of the first bending transducer and the free end of the second bending transducer.

18. The micromechanical sound transducer according to claim 1, comprising a second bending transducer comprising a free end and being arranged in a mutual plane with the first bending transducer so that the free end of the first bending transducer is separated from the free end second bending transducer via a slit, wherein the second bending transducer is excited in-phase with the vertical vibration of the first bending transducer.

19. The micromechanical sound transducer according to claim 18, wherein the first and the second bending transducer are bending transducers of the same type.

20. The micromechanical sound transducer according to claim 1, wherein the first and/or a second bending transducer is a planar, trapezoid-shaped or rectangular bending transducer.

21. The micromechanical sound transducer according to claim 1, wherein the first and/or a second bending transducer is a triangular or circular segment-shaped or rounded bending transducer.

22. The micromechanical sound transducer according to claim 17, comprising one or several further bending transducers arranged in a mutual surface area so that their free ends are separated from the free ends of the first and/or a second bending transducer via a slit, wherein the at least one further bending transducer is excited to vibrate vertically in-phase with the vertical vibration of the first and/or the second bending transducer.

23. The micromechanical sound transducer according to claim 18, comprising a controller that drives the first and the second bending transducer such that they are excited to vibrate vertically in-phase.

24. The micromechanical sound transducer according to claim 1, comprising a sensor system configured to sense the vertical vibration and/or the position of the first and/or the second bending transducer.

25. The micromechanical sound transducer according to claim 1, wherein the slit exists in the idle state of the first bending transducer.

26. The micromechanical sound transducer according to claim 1, wherein the first bending transducer is clamped in on one side or on several sides opposite to the substrate and/or a base element.

27. The micromechanical sound transducer according to claim 1, wherein the first bending transducer or a second bending transducer each comprise a first and a second bending element connected in series in order to form the respective bending transducer.

28. The micromechanical sound transducer according to claim 27, wherein the first bending element comprises a clamped-in end and a free end, and the second element grips with its clamped-in end the free end of the first bending element and forms with its free end the free end of the first and/or the second bending transducer.

29. The micromechanical sound transducer according to claim 27, wherein the first bending element is connected to the second bending element via a flexible element.

30. The micromechanical sound transducer according to claim 27, wherein the micromechanical sound transducer comprises a frame.

31. The micromechanical sound transducer according to claim 30, wherein the frame is arranged in an area of transition between the first and the second bending element.

32. The micromechanical sound transducer according to claim 27, wherein the first bending element and the second bending element may be driven with different control signals.

33. A method for manufacturing a micromechanical sound transducer set up in a substrate, the micromechanical sound transducer comprising a first bending transducer extending along a plane of the substrate, and a diaphragm element extending vertically to the first bending transducer, the method comprising:

structuring a layer in order to form the first bending transducer so that it comprises a free end or a free side and is configured to be excited to vibrate vertically in order to emit or receive sound; and realizing the vertical diaphragm element so that it extends beyond the layer of the first bending transducer and is separated from the free end of the first bending transducer via a slit;

wherein the slit is smaller than 1% or smaller than 0.1% or smaller than 0.01% of the surface area of the first bending transducer and wherein, upon a deflection, the slit is smaller than 10%, 5%, 1%, 0.1% or 0.01% of the surface area of the first bending transducer.

34. A method for manufacturing a micromechanical sound transducer set up in a substrate, the micromechanical sound transducer comprising a first bending transducer extending along a plane of the substrate, and a diaphragm element extending vertically to the first bending transducer, the method comprising:

structuring a layer in order to form the first bending transducer so that it comprises a free end or a free side and is configured to be excited to vibrate vertically in order to emit or receive sound; and realizing the vertical diaphragm element so that it extends beyond the layer of the first bending transducer and is separated from the free end of the first bending transducer via a slit;

wherein the micromechanical sound transducer comprises a lid that is placed onto the substrate in the area of the first bending transducer so that at least the first bending transducer and the diaphragm element are covered by the lid or the first substrate, and wherein the lid forms the diaphragm element.

35. A micromechanical sound transducer with a first bending transducer, the micromechanical sound transducer comprising a free end or a free side and is configured to be excited to vibrate vertically in order to emit or receive sound;

wherein the first bending transducer comprises a first and a second bending element connected in series in order to form the first bending transducer, wherein the first bending element may be driven with a first control signal and the second bending element may be driven with a second control signal;

wherein the first bending element comprises a clamped-in end and a free end, and the second element grips with its clamped-in end the free end of the first bending element and forms with its free end the free end of the first and/or the second bending transducer, and wherein the first bending element is connected to the second bending element via a flexible element or a connection element.

36. The micromechanical sound transducer according to claim 35, wherein the first control signal differs from the second control signal.

37. The micromechanical sound transducer according to claim 36, wherein the first control signal and the second control signal are derived from a mutual original signal and wherein the first control signal is modified with respect to the second control signal.

38. The micromechanical sound transducer according to claim 36, wherein the first control signal comprises a frequency range that differs from the second control signal or partially overlaps the same, and wherein the first control signal and the second control signal are derived from a mutual original signal and wherein the first control signal has experienced a different frequency filtering than the second control signal.

39. The micromechanical sound transducer according to claim 38, wherein the first control signal comprises a lower frequency range than the second control signal.

40. The micromechanical sound transducer according to claim 35, comprising a second bending transducer that comprises a free end and is arranged in a mutual plane with the first bending transducer, wherein the second bending transducer comprises a first and a second bending element connected in series so as to form the second bending transducer.

41. The micromechanical sound transducer according to claim 35, wherein the micromechanical sound transducer comprises a frame.

42. The micromechanical sound transducer according to claim 41, wherein the frame is arranged in an area of transition between the first and the second bending element.

43. The micromechanical sound transducer according to claim 35, wherein the first bending element and the second bending element are driven with different control signals.

44. The micromechanical sound transducer according to claim 35, wherein the first and/or a second bending transducer is a planar, trapezoid-shaped or rectangular bending transducer.

45. The micromechanical sound transducer according to claim 35, wherein the first and/or a second bending transducer is a triangular or circular segment-shaped bending transducer.

46. The micromechanical sound transducer according to claim 35, comprising one or several further bending transducers that are arranged in a mutual plane so that their free ends are separated from the free ends of the first and/or a second bending transducer via a slit, wherein the at least one further bending transducer is excited to vibrate vertically in-phase with the vertical vibration of the first and/or the second bending transducer.

47. The micromechanical sound transducer according to claim 35, wherein the slit is smaller than 10% or smaller than 5% or than 1% or than 0.1% or smaller than 0.01% of the surface of the first bending transducer.

48. The micromechanical sound transducer according to claim 35, wherein, upon deflection, the slit is smaller than 15% or smaller than 10%, 5%, 1% or 0.1%, or smaller than 0.01% of the area of the first bending transducer.

49. A method for manufacturing a micromechanical sound transducer according to claim 35, the micromechanical sound transducer comprising a first bending transducer, the method comprising:

providing in a mutual plane a first layer that at least forms the first bending transducer with a first and a second bending element each so that the first bending transducer comprises a free end; and connecting the respective first bending element to the second bending element of the respective first bending transducer.

50. The micromechanical sound transducer according to claim 1, wherein two bending transducers are positioned with their clamped-in ends opposite to a substrate, wherein the geometry of the first of the two bending transducers is enclosed or surrounded by the geometry of the second of the two bending transducers.

51. The micromechanical sound transducer according to claim 35, wherein two bending transducers are positioned with their clamped-in ends opposite to a substrate, wherein the geometry of the first of the two bending transducers is enclosed or surrounded by the geometry of the second of the two bending transducers.

52. The micromechanical sound transducer according to claim 50, wherein the second of the two bending transducers comprises a recess for the first of the two bending transducers.

53. The micromechanical sound transducer according to claim 50, wherein the two bending transducers are separated via a slit or a slit with a diaphragm.

54. The micromechanical sound transducer according to claim 50, wherein the two bending transducers may be driven with two different control signals or with two control signals for two different frequency ranges.

55. A micromechanical sound transducer for emitting sound, being set up in a substrate, comprising:

a first bending transducer that extends along a plane of the substrate and comprises a free end or a free side and is configured to be excited to vibrate vertically in order to emit a sound; and a diaphragm element extending vertically to the first bending transducer, the diaphragm element being separated from the free end or the free side of the first bending transducer via a slit;

wherein the slit is smaller than 5% or smaller than 1% or smaller than 0.1% or smaller than 0.01% of the surface area of the first bending transducer and wherein, upon a deflection, the slit is smaller than 10%, 5%, 1%, 0.1% or 0.01% of the surface area of the first bending transducer;

wherein the micromechanical sound transducer comprises a second bending transducer with a free end, the second bending transducer being arranged in a mutual plane with the first bending transducer, and wherein the diaphragm element is arranged between the free end of the first bending transducer and the free end of the second bending transducer; or further comprising one or several further bending transducers arranged in a mutual surface area so that their free ends are separated from the free ends of the first and/or a second bending transducer via a slit, wherein the at least one further bending transducer is excited to vibrate vertically in-phase with the vertical vibration of the first and/or the second bending transducer.

56. The micromechanical sound transducer according to claim 1, wherein the slit is smaller than 1% or smaller than 0.1% or smaller than 0.01% of the surface area of the first bending transducer and wherein, upon a deflection, the slit is smaller than 5%, 1%, 0.1% or 0.01% of the surface area of the first bending transducer.

* * * * *